US010253585B2

(12) United States Patent
Hickie

(10) Patent No.: US 10,253,585 B2
(45) Date of Patent: Apr. 9, 2019

(54) MANAGED PRESSURE DRILLING MANIFOLD, MODULES, AND METHODS

(71) Applicant: TECH ENERGY PRODUCTS, L.L.C., Bossier City, LA (US)

(72) Inventor: Barton Hickie, Oklahoma City, OK (US)

(73) Assignee: TECH ENERGY PRODUCTS, L.L.C., Bossier City, LA (US)

( * ) Notice: Subject to any disclaimer, the term of this patent is extended or adjusted under 35 U.S.C. 154(b) by 0 days.

(21) Appl. No.: 15/704,747

(22) Filed: Sep. 14, 2017

(65) Prior Publication Data

US 2018/0283113 A1 Oct. 4, 2018

Related U.S. Application Data

(60) Provisional application No. 62/480,158, filed on Mar. 31, 2017.

(51) Int. Cl.
*E21B 21/10* (2006.01)
*E21B 41/00* (2006.01)
*E21B 34/16* (2006.01)

(52) U.S. Cl.
CPC ..... *E21B 21/106* (2013.01); *E21B 34/16* (2013.01); *E21B 41/0092* (2013.01)

(58) Field of Classification Search
None
See application file for complete search history.

(56) References Cited

U.S. PATENT DOCUMENTS 3,429,385 A 2/1969 Jones et al.
2011/0139464 A1 6/2011 Henderson et al.
2012/0255777 A1* 10/2012 Bernard ..... E21B 21/08 175/25
2016/0138351 A1 5/2016 Dillard et al.
2016/0298401 A1 10/2016 Cotton et al.

FOREIGN PATENT DOCUMENTS

AU 2009101354 9/2011

OTHER PUBLICATIONS

Strata Dual SAC MPD Manifold & SAC Control Panel, Strata Energy Services, accessed Feb. 2017, 1 pg.
MPD Manifold 4"x6" 2000 psi with Integrated Control System, accessed Feb. 2017, 3 pgs.
MPD Manifold 4-1/16" 5000 psi with Integrated Control System, accessed Feb. 2017, 3 pgs.
Weatherford, Secure Drilling™ System, Apr. 19, 2009, 1 pg.
Weatherford, Early Kick/Loss Detection Services, 2011-2012, 12 pgs.
Mi Swaco, Choke Manifolds: Tailored solutions that keep the lid on pressure, and flow, 2012, 12 pgs.
Magnum Technology Center, Managed Pressure Drilling Manifold 5k PSI—Availability Update, Feb. 24, 2014, 5 pgs.
Pruitt Company, Optimal MPD Lite™ Choke Manifold, accessible Mar. 1, 2017, 2 pgs.
International Search Report and Written Opinion issued by the ISA/US regarding International application No. PCT/US18/25421 dated Aug. 29, 2018, 14 pages.

* cited by examiner

*Primary Examiner* — D. Andrews
(74) *Attorney, Agent, or Firm* — Haynes and Boone, LLP

(57) ABSTRACT

A managed pressure drilling ("MPD") manifold is adapted to receive drilling mud from a wellbore during oil and gas drilling operations. The MPD manifold includes one or more drilling chokes.

38 Claims, 28 Drawing Sheets

MANAGED PRESSURE DRILLING MANIFOLD, MODULES, AND METHODS

CROSS-REFERENCE TO RELATED APPLICATION

This application claims the benefit of the filing date of, and priority to, U.S. Application No. 62/480,158, filed Mar. 31, 2017, the entire disclosure of which is hereby incorporated herein by reference.

TECHNICAL FIELD

The present disclosure relates generally to oil and gas exploration and production operations and, more particularly, to a managed pressure drilling ("MPD") manifold used during oil and gas drilling operations.

BACKGROUND

An MPD system may include drilling choke(s) and a flow meter, with the drilling choke(s) and the flow meter being separate and distinct from one another. The drilling choke(s) are in fluid communication with a wellbore that traverses a subterranean formation. As a result, the drilling system may be used to control backpressure in the wellbore as part of an adaptive drilling process that allows greater control of the annular pressure profile throughout the wellbore. During such a process, the flow meter measures the flow rate of drilling mud received from the wellbore. In some cases, the configuration of the drilling choke(s) and/or the flow meter may decrease the efficiency of drilling operations, thereby presenting a problem for operators dealing with challenges such as, for example, continuous duty operations, harsh downhole environments, and multiple extended-reach lateral wells, among others. Further, the configuration of the drilling choke(s) and/or the flow meter may adversely affect the transportability and overall footprint of the drilling choke(s) and/or the flow meter at the wellsite. Finally, the separate and distinct nature of the drilling choke(s) and the flow meter can make it difficult to inspect, service, or repair the drilling choke(s) and/or the flow meter, and/or to coordinate the inspection, service, repair, or replacement of the drilling choke(s) and/or the flow meter. Therefore, what is needed is an assembly, apparatus, or method that addressed one or more of the foregoing issues, and/or one or more other issues.

DETAILED DESCRIPTION

Figure 1:
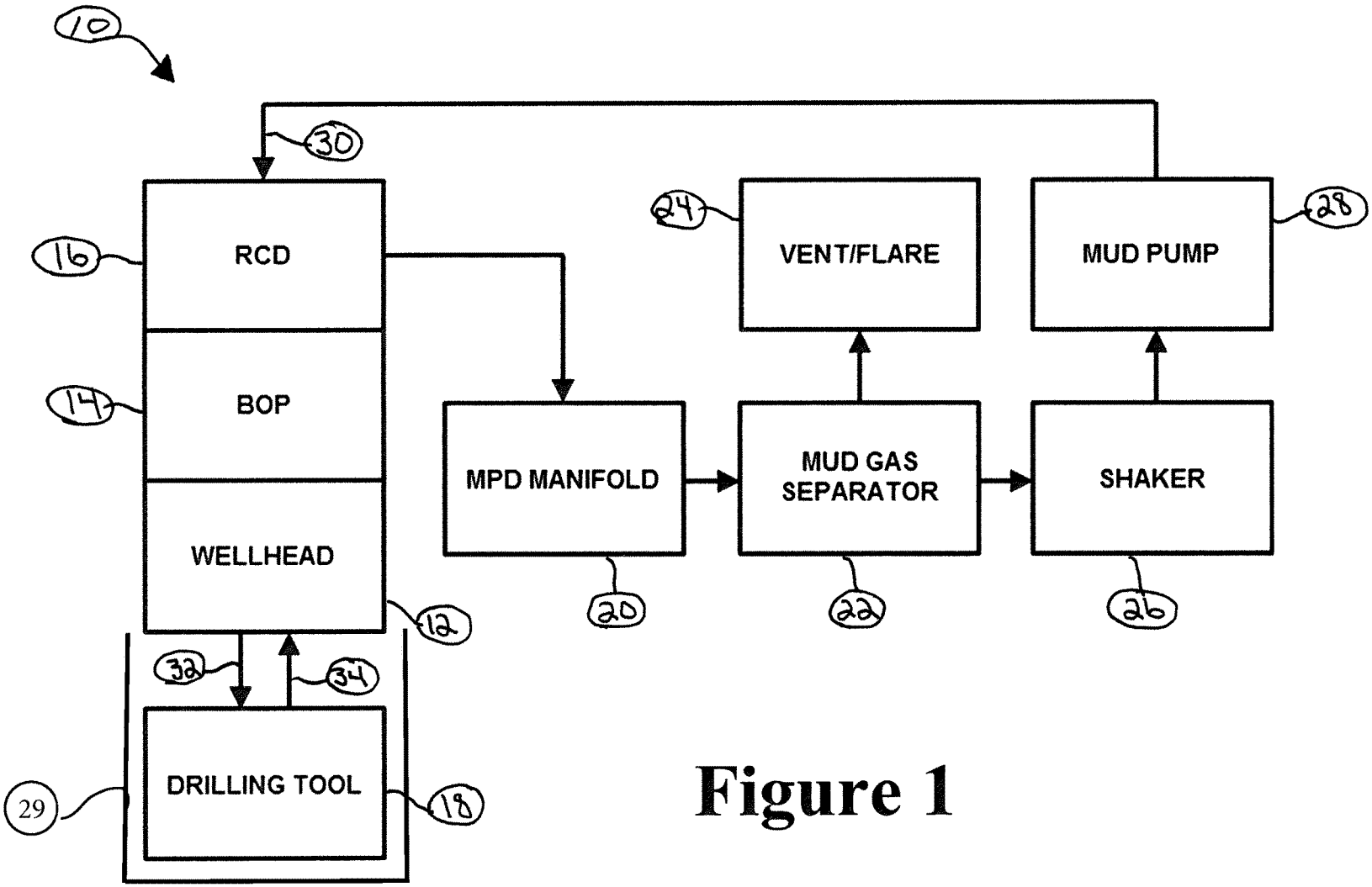
FIG. 1 is a diagrammatic view of a drilling system including, among other components, an MPD manifold, according to an illustrative embodiment.

In an illustrative embodiment, as depicted in FIG. 1, a drilling system is generally referred to by the reference numeral 10. The drilling system 10 includes a wellhead 12, a blowout preventer ("BOP") 14, a rotating control device ("RCD") 16, a drilling tool 18, an MPD manifold 20, a mud gas separator ("MGS") 22, a vent or flare 24, a shaker 26, and a mud pump 28. The wellhead 12 is located at the top or head of an oil and gas wellbore 29 that penetrates one or more subterranean formations, and is used in oil and gas exploration and production operations such as, for example, drilling operations. The BOP 14 is operably coupled to the wellhead 12 to prevent blowout, i.e., the uncontrolled release of crude oil and/or natural gas from the wellbore 29 during drilling operations. The drilling tool 18 is operably coupled to a drill string (not shown), and extends within the wellbore 29. The drill string extends into the wellbore 29 through the BOP 14 and the wellhead 12. Moreover, the RCD 16 is operably coupled to the BOP 14, opposite the wellhead 12, and forms a friction seal around the drill string. The MPD manifold 20 is operably coupled to, and in fluid communication with, the RCD 16. The MGS 22 is operably coupled to, and in fluid communication with, the MPD manifold 20. The flare 24 and the shaker 26 are both operably coupled to, and in fluid communication with, the MGS 22. The mud pump 28 is operably coupled between, and in fluid communication with, the shaker 26 and the drill string.

In operation, the drilling system 10 is used to extend the reach or penetration of the wellbore 29 into the one or more subterranean formations. To this end, the drill string is rotated and weight-on-bit is applied to the drilling tool 18, thereby causing the drilling tool 18 to rotate against the bottom of the wellbore 29. At the same time, the mud pump 28 circulates drilling fluid to the drilling tool 18, via the drill string, as indicated by the arrows 30 and 32. The drilling fluid is discharged from the drilling tool 18 into the wellbore 29 to clear away drill cuttings from the drilling tool 18. The drill cuttings are carried back to the surface by the drilling fluid via an annulus of the wellbore 29 surrounding the drill string, as indicated by the arrow 34. The drilling fluid and the drill cuttings, in combination, are also referred to herein as "drilling mud."

As indicated by the arrow 34 in FIG. 1, the drilling mud flows into the RCD 16 through the wellhead 12 and the BOP 14. The RCD 16 diverts the flow of the drilling mud to the MPD manifold 20 while preventing, or at least reducing, communication between the annulus of the wellbore 29 and atmosphere. In this manner, the RCD 16 enables the drilling system 10 to operate as a closed-loop system. The MPD manifold 20 receives the drilling mud from the RCD 16, and is adjusted to maintain the desired backpressure within the wellbore 29, as will be discussed in further detail below. The MGS 22 receives the drilling mud from the MPD manifold 20, and captures and separates gas from the drilling mud. The captured and separated gas is sent to the flare 24 to be burnt off. Alternatively, the flare 24 is omitted and the captured and separated gas is reinjected into the one or more subterranean formations. The shaker 26 receives the drilling mud from the MGS 22, and removes the drill cuttings therefrom. The mud pump 28 then recirculates the drilling fluid to the drilling tool 18, via the drill string.

Figure 2:
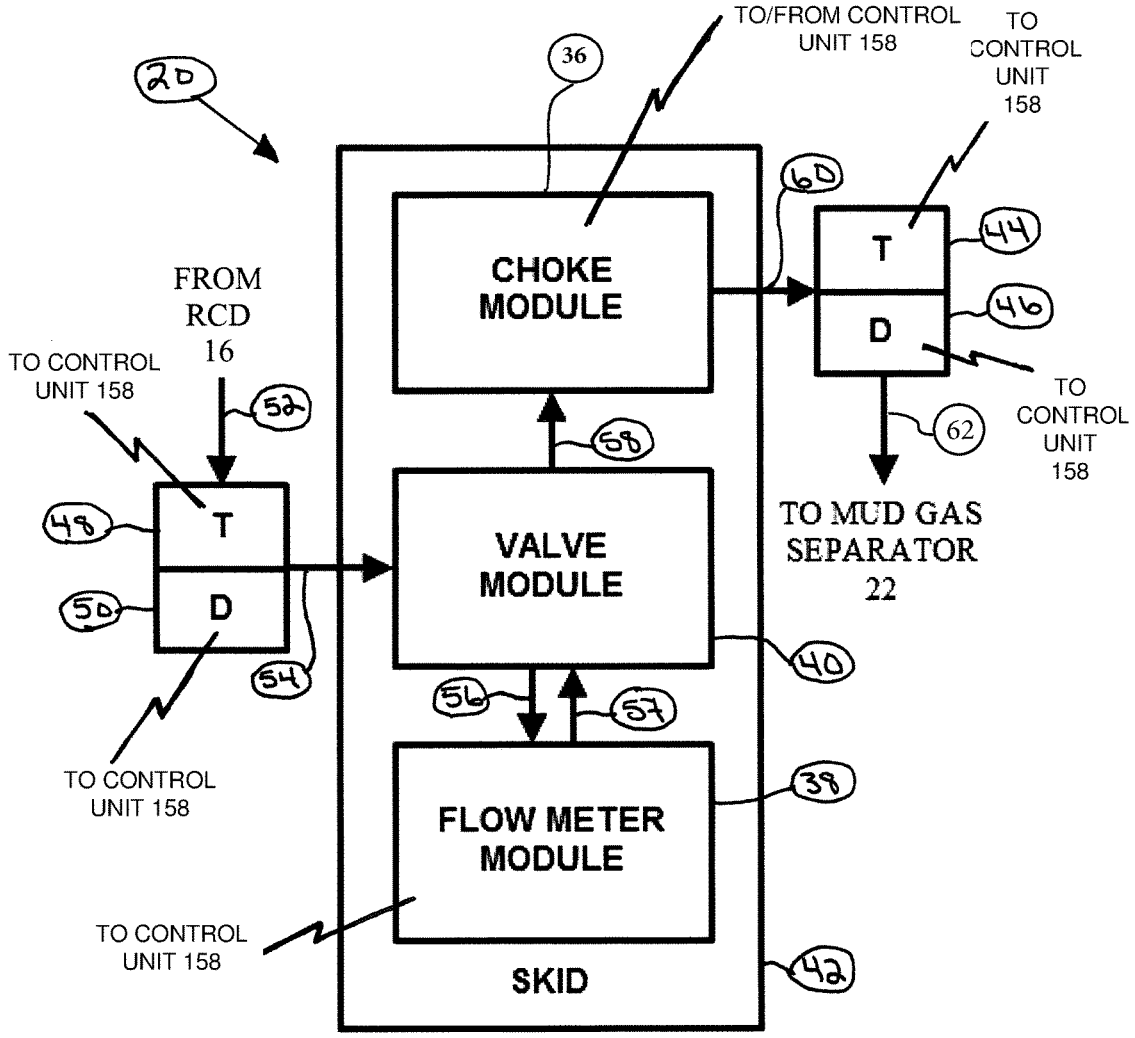
FIG. 2 is a diagrammatic view of the MPD manifold of FIG. 1, the MPD manifold including a choke module, a flow meter module, and a valve module, according to an illustrative embodiment.
Figure 3:
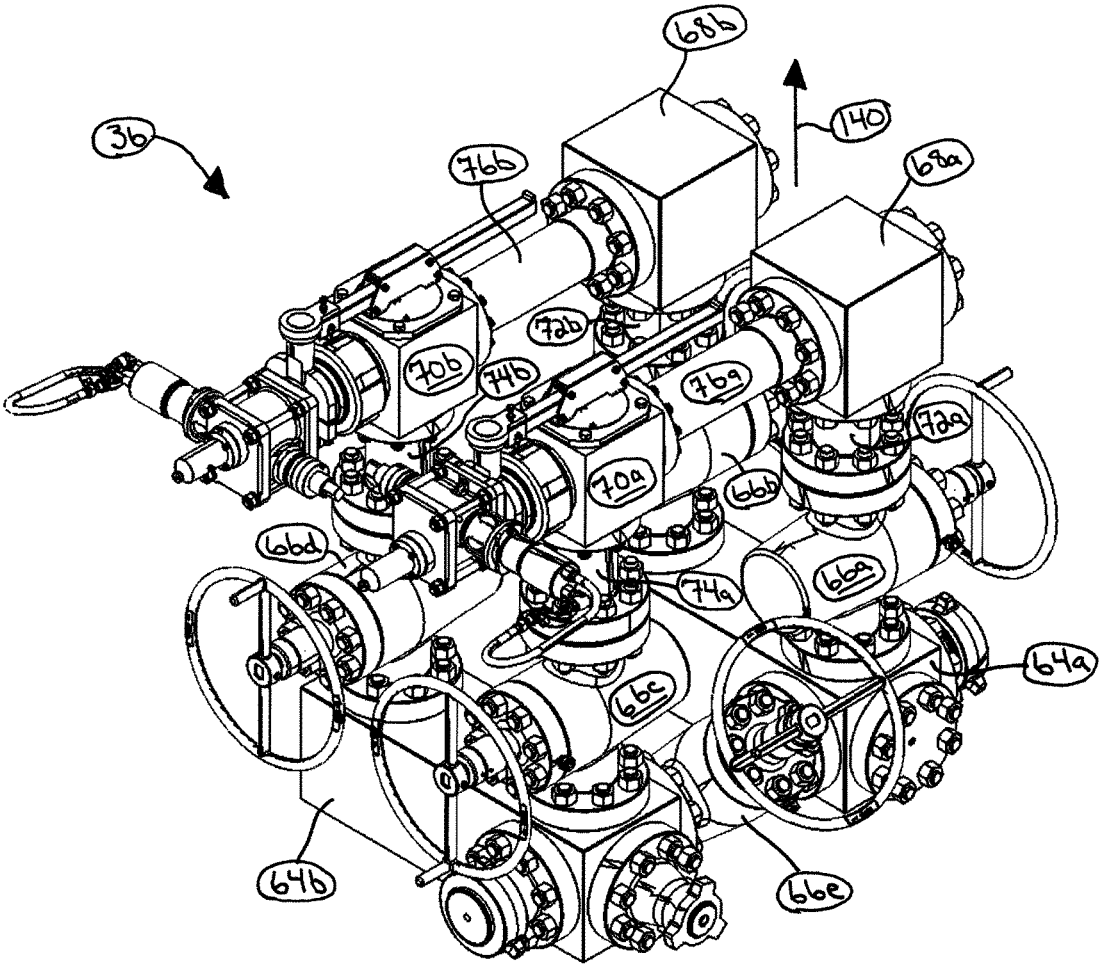
FIG. 3 is a perspective view of the choke module of FIG. 2, the choke module including a pair of flow blocks, according to an illustrative embodiment.

In an illustrative embodiment, as depicted in FIG. 2 with continuing reference to FIG. 1, the MPD manifold 20 includes a choke module 36, a flow meter module 38, and a valve module 40. The choke module 36 is operably coupled to, and adapted to be in fluid communication with, the flow meter module 38 via the valve module 40. The choke module 36, the flow meter module 38, and the valve module 40 are together mounted to a skid 42. In some embodiments, one or more instruments such as, for example, a temperature sensor 44, a densometer 46, and one or more pressure sensors, are operably coupled to the choke module 36. Additionally, one or more instruments such as, for example, a temperature sensor 48, a densometer 50, and one or more other pressure sensors, are operably coupled to the valve module 40. In some embodiments, one or more of the temperature sensors 44 and 48, one or more of the densometers 46 and 50, and pressure sensor(s) are also mounted to the skid 42. In some embodiments, one or more of the temperature sensors 44 and 48, one or more of the densometers 46 and 50, and pressure sensor(s) are part of the MPD manifold 20. In addition to, or instead of, being mounted to the skid 42, the choke module 36, the flow meter module 38, and the valve module 40 may be freestanding on the ground or mounted to a trailer (not shown) that can be towed between operational sites.

During the operation of the drilling system 10, the valve module 40 receives the drilling mud from the RCD 16, as indicated by arrows 52 and 54. The temperature sensor 48 measures the temperature of the drilling mud immediately before the drilling mud is received by the valve module 40. In addition, the densometer 50 measures the density of the drilling mud immediately before the drilling mud is received by the valve module 40. In some embodiments, one or more pressure sensors (not shown in FIG. 2) measure the pressure of the drilling mud immediately before the drilling mud is received by the valve module 40; in some embodiments, the temperature sensor 48 and/or the densometer 50 includes the one or more pressure sensors. The valve module 40 routes the drilling mud to the flow meter module 38, as indicated by arrow 56. The flow meter module 38 measures the flow rate of the drilling mud before communicating the drilling mud back to the valve module 40, as indicated by arrow 57. The valve module 40 then routes the drilling mud to the choke module 36, as indicated by arrow 58. The choke module 36 is adjusted to maintain the desired backpressure of the drilling mud within the wellbore 29. The MGS 22 receives the drilling mud from the choke module 36, as indicated by arrows 60 and 62. The temperature sensor 44 measures the temperature of the drilling mud immediately after the drilling mud is discharged from the choke module 36. In addition, the densometer 46 measures the density of the drilling mud immediately after the drilling mud is discharged from the choke module 36. In some embodiments, one or more other pressure sensors (not shown in FIG. 2) measure the pressure of the drilling mud immediately after the drilling mud is discharged from the choke module 36; in some embodiments, the temperature sensor 44 and/or the densometer 46 includes the one or more other pressure sensors.

In some embodiments, one of which is described in further detail below with reference to FIG. 26, the temperature sensor 44 and the densometer 46 are operably coupled to the valve module 40 rather than being operably coupled to the choke module 36. Additionally, the temperature sensor 48 and the densometer 50 are operably coupled to the choke module 36 rather than being operably coupled to the valve module 40. As a result, the choke module 36 receives the drilling mud from the RCD 16 and the MGS 22 receives the drilling mud from the valve module 40, as will be described in further detail below with reference to FIG. 26. In some embodiments, pressure sensor(s) are also operably coupled to the valve module 40. In some embodiments, pressure sensor(s) are also operably coupled to the choke module 36.

In an illustrative embodiment, as depicted in FIG. 3-6 with continuing reference to FIG. 2, the choke module 36 includes flow blocks 64*a-b*, valves 66*a-e*, flow blocks 68*a-b*, and drilling chokes 70*a-b*. The valves 66*a-e* are each actuable between an open position in which fluid flow is permitted therethrough, and a closed position in which fluid flow therethrough is prevented, or at least reduced. In some embodiments, the valves 66*a-e* are gate valves. Alternatively, one or more of the valves 66*a-e* may be another type of valve such as, for example, a plug valve. The valve 66*e* is operably coupled between the flow blocks 64*a* and 64*b*. The valve 66*a* is operably coupled to the flow block 64*a*. The flow block 68*a* is operably coupled to the valve 66*a*, opposite the flow block 64*a*, via, for example, a spool 72*a*. The valve 66*c* is operably coupled to the flow block 64*b*. The drilling choke 70*a* is operably coupled to the valve 66*c*, opposite the flow block 64*b*, via, for example, a spool 74*a*. The flow block 68*a* is operably coupled to the drilling choke 70*a* via, for example, a spool 76*a*. The valve 66*b* is operably coupled to the flow block 64*a*, adjacent the valve 66*a*. The flow block 68*b* is operably coupled to the valve 66*b*, opposite the flow block 64*a*, via, for example, a spool 72*b*. The valve 66*d* is operably coupled to the flow block 64*b*, adjacent the valve 66*c*. The drilling choke 70*b* is operably coupled to the valve 66*d*, opposite the flow block 64*b*, via, for example, a spool 74*b*. The flow block 68*b* is operably coupled to the drilling choke 70*b* via, for example, a spool 76*b*.

The choke module 36 is actuable between a backpressure control configuration and a choke bypass configuration. In the backpressure control configuration, the flow block 64*b* is in fluid communication with the flow block 64*a* via one or both of the drilling chokes 70*a* and 70*b*. In some embodiments, when the choke module 36 is in the backpressure control configuration, the flow block 64*b* is not in fluid communication with the flow block 64*a* via the valve 66*e*. During the operation of the drilling system 10, when the choke module 36 is in the backpressure control configuration, one or both of the drilling chokes 70*a* and 70*b* are adjusted to account for changes in the flow rate of the drilling mud so that the desired backpressure within the wellbore 29 is maintained. In the choke bypass configuration, the flow block 64*b* is in fluid communication with the flow block 64*a* via the valve 66*e*. In some embodiments, when the choke module 36 is in the choke bypass configuration, the flow block 64*b* is not in fluid communication with the flow block 64*a* via the drilling chokes 70*a* or 70*b*. To enable such fluid communication between the flow blocks 64*a* and 64*b* via the valve 66*e*, the valves 66*a-d* are closed and the valve 66*e* is open.

In some embodiments, one or both of the drilling chokes 70*a-b* are manual chokes, thus enabling rig personnel to manually control backpressure within the drilling system 10 when the choke module 36 is in the backpressure control configuration. In some embodiments, one or both of the drilling chokes 70*a* and 70*b* are automatic chokes controlled automatically by electronic pressure monitoring equipment when the choke module 36 is in the backpressure control configuration. In some embodiments, one or both of the drilling chokes 70*a* and 70 are combination manual/automatic chokes.

In some embodiments, when the choke module 36 is in the backpressure control configuration, the flow block 64*b* is in fluid communication with the flow block 64*a* via at least the drilling choke 70*a*. To enable such fluid communication between the flow blocks 64*a* and 64*b* via the drilling choke 70*a*, the valves 66*a* and 66*c* are open, and the valves 66*b*, 66*d*, and 66*e* are closed. As a result, the flow block 64*b* is in fluid communication with the flow block 64*a* via the valve 66*c*, the spool 74*a*, the drilling choke 70*a*, the spool 76*a*, the flow block 68*a*, the spool 72*a*, and the valve 66*a*.

In some embodiments, when the choke module 36 is in the backpressure control configuration, the flow block 64*b* is in fluid communication with the flow block 64*a* via at least the drilling choke 70*b*. To enable such fluid communication between the flow blocks 64*a* and 64*b* via the drilling choke 70*b*, the valves 66*b* and 66*d* are open, and the valves 66*a*, 66*c*, and 66*e* are closed. As a result, the flow block 64*b* may be in fluid communication with the flow block 64*a* via the valve 66*d*, the spool 74*b*, the drilling choke 70*b*, the spool 76*b*, the flow block 68*b*, the spool 72*b*, and the valve 66*b*.

In some embodiments, when the choke module 36 is in the backpressure control configuration, the flow block 64*b* is in fluid communication with the flow block 64*a* via the drilling choke 70*a* and the drilling choke 70*b*. To enable such fluid communication between the flow block 64*a* and 64*b* via the drilling chokes 70*a* and 70*b*, the valves 66*a-d* are open, and the valve 66*e* is closed. As a result, the flow block 64*b* may be in fluid communication with the flow block 64*a* via the valve 66*c*, the spool 74*a*, the drilling choke 70*a*, the spool 76*a*, the flow block 68*a*, the spool 72*a*, and the valve 66*a*, as well as via the valve 66*d*, the spool 74*b*, the drilling choke 70*b*, the spool 76*b*, the flow block 68*b*, the spool 72*b*, and the valve 66*b*.

Figure 6:
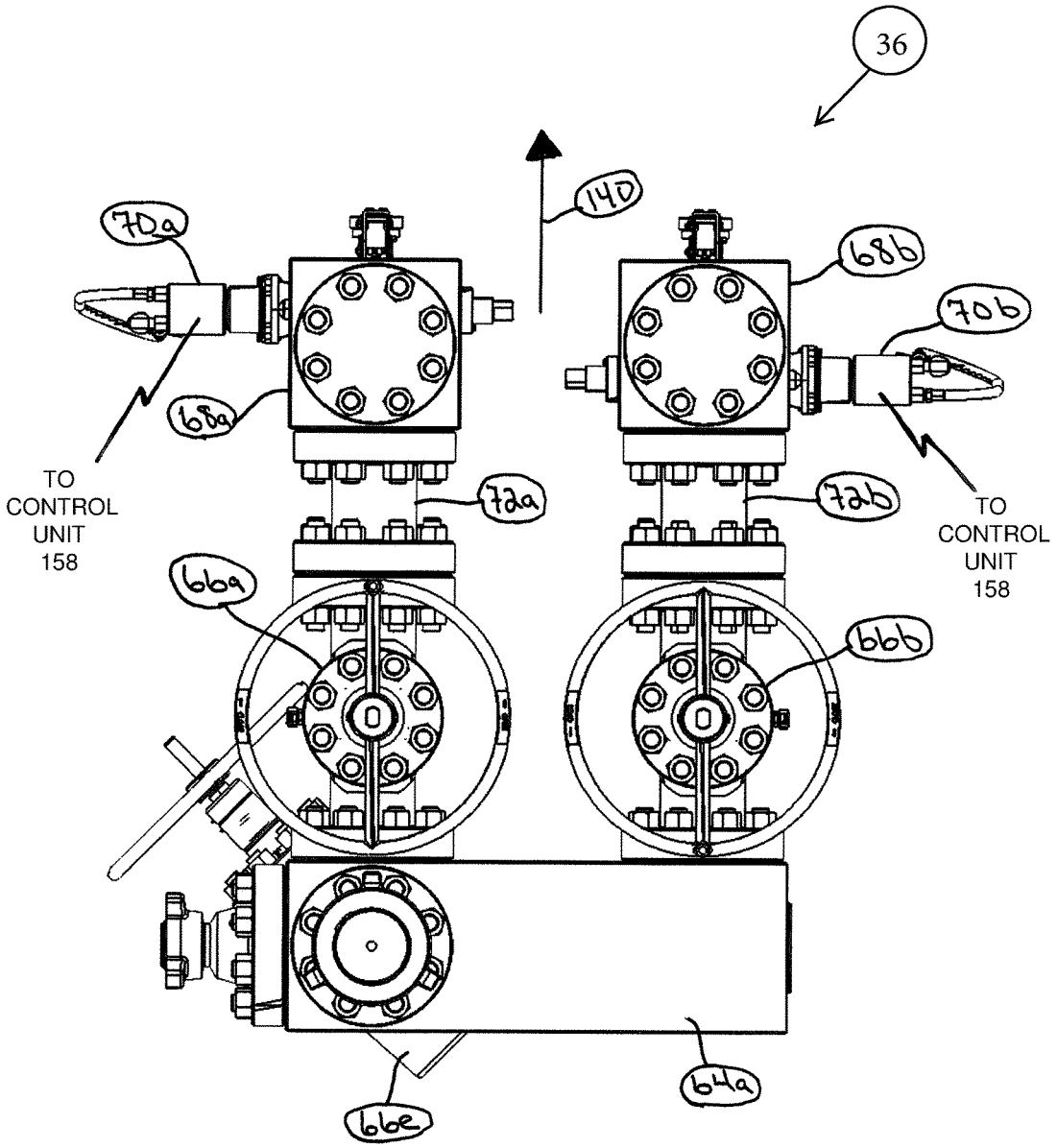
FIG. 6 is a left side elevational view of the choke module of FIGS. 3-5, according to an illustrative embodiment.
Figure 7:
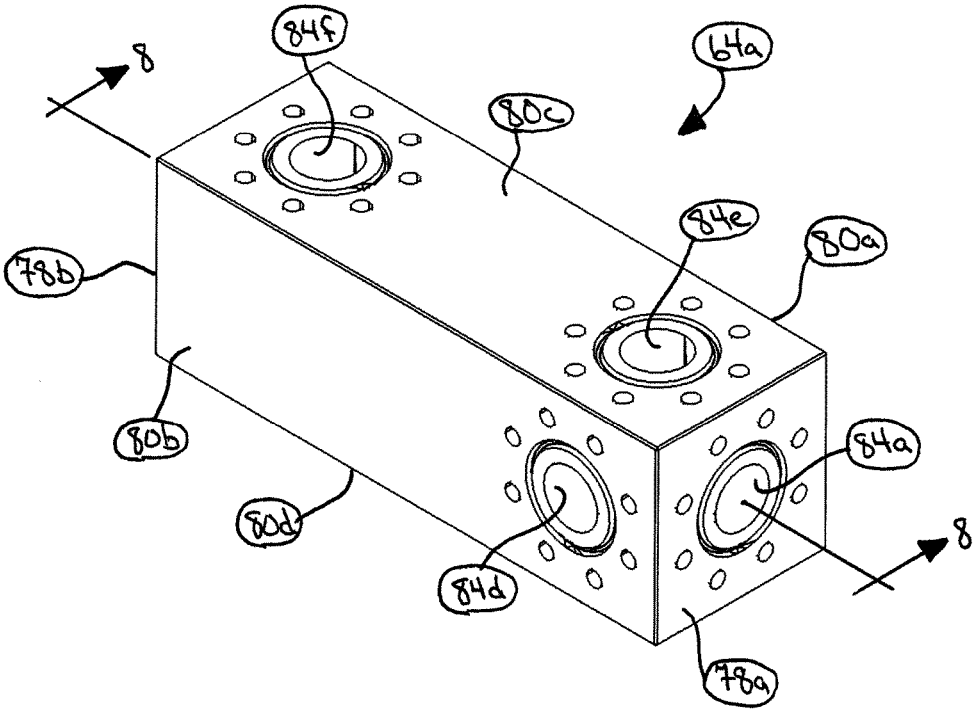
FIG. 7 is a perspective view of one of the flow blocks of FIGS. 3-6, according to an illustrative embodiment.
Figure 8:
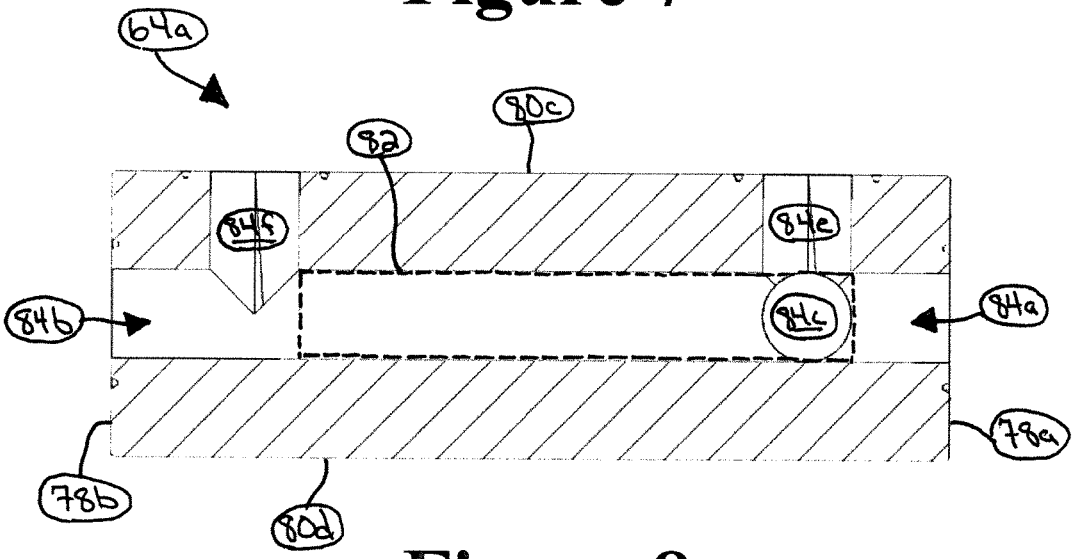
FIG. 8 is a cross-sectional view of the flow block of FIG. 7, taken along line 8-8 of FIG. 7, according to an illustrative embodiment.

In some embodiments, the flow blocks 64*a* and 64*b* are substantially identical to one another and, therefore, in connection with FIGS. 7 and 8, only the flow block 64*a* will be described in detail below; however, the description below applies to both of the flow blocks 64*a* and 64*b*. In an illustrative embodiment, as depicted in FIGS. 7 and 8 with continuing reference to FIGS. 3-6, the flow block 64*a* includes ends 78*a-b* and sides 80*a-d*. In some embodiments, the ends 78*a* and 78*b* are spaced in a substantially parallel relation. In some embodiments, the sides 80*a* and 80*b* are spaced in a substantially parallel relation, each extending from the end 78*a* to the end 78*b*. In some embodiments, the sides 80*c* and 80*d* are spaced in a substantially parallel relation, each extending from the end 78*a* to the end 78*b*. In some embodiments, one of which is shown in FIGS. 7 and 8, the sides 80*a* and 80*b* are spaced in a substantially parallel relation, and the sides 80*c* and 80*d* are spaced in a substantially parallel relation. In some embodiments, the sides 80*a* and 80*b* are spaced in a substantially perpendicular relation with the sides 80*c* and 80*d*. In some embodiments, the ends 78*a* and 78*b* are spaced in a substantially perpendicular relation with the sides 80*a* and 80*b*. In some embodiments, the ends 78*a* and 78*b* are spaced in a substantially perpendicular relation with the sides 80*c* and 80*d*. In some embodiments, one or which is shown in FIGS. 7 and 8, the ends 78*a* and 78*b* are spaced in a substantially perpendicular relation with the sides 80*a*, 80*b*, 80*c*, and 80*d*.

In addition, the flow block 64*a* defines an internal region 82 and fluid passageways 84*a-f*. In some embodiments, the fluid passageway 84*a* extends through the end 78*a* of the flow block 64*a* into the internal region 82. In some embodiments, the fluid passageway 84*b* extends through the end 78*b* of the flow block 64*a* into the internal region 82. In some embodiments, one of which shown in FIGS. 7 and 8, the fluid passageway 84*a* extends through the end 78*a* of the flow block 64*a* into the internal region 82, and the fluid passageway 84*b* extends through the end 78*b* of the flow block 64*a* into the internal region 82. In some embodiments, the fluid passageways 84*a* and 84*b* form a continuous fluid passageway together with the internal region 82. In some embodiments, the fluid passageway 84*c* extends through the side 80*a* of the flow block 64*a* into the internal region 82. In some embodiments, the fluid passageway 84*d* extends through the side 80*b* of the flow block 64*a* into the internal region 82. In some embodiments, one of which is shown in FIGS. 7 and 8, the fluid passageway 84*c* extends through the side 80*a* of the flow block 64*a* into the internal region 82, and the fluid passageway 84*d* extends through the side 80*b* of the flow block 64*a* into the internal region 82. In some embodiments, the fluid passageways 84*c* and 84*d* form a continuous fluid passageway together with the internal region 82. In some embodiments, one of which is shown in FIGS. 7 and 8, the fluid passageways 84*e* and 84*f* each extend through the side 80*c* of the flow block 64*a* into the internal region 82. In some embodiments, one or more of the fluid passageways 84*a*, 84*c*, or 84*d* are omitted from the flow block 64*a*, and/or one or more fluid passageways analogous to the fluid passageways 84*a*, 84*c*, or 84*d* of the flow block 64*a* are omitted from the flow block 64*b*.

Referring back to FIGS. 3-6, it can be seen that the valve 66*a* is operably coupled to the side 80*c* of the flow block 64*a* and in fluid communication with the internal region 82 thereof via the fluid passageway 84*e*, and the valve 66*b* is operably coupled to the side 80*c* of the flow block 64*a* and in fluid communication with the internal region 82 thereof via the fluid passageway 84*f*. The valves 66*c* and 66*d* are operably coupled to the flow block 64*b* in substantially the same manner as the manner in which the valves 66*a* and 66*b* are operably coupled to the flow block 64*a*. The valve 66*e* is operably coupled to the side 80*b* of the flow block 64*a* and in fluid communication with the internal region 82 thereof via the fluid passageway 84*d*. Moreover, the valve 66*e* is operably coupled to the flow block 64*b* in substantially the same manner as the manner in which the valve 66*e* is operably coupled to the flow block 64*a*, except that the valve 66*e* is operably coupled to a side of the flow block 64*b* analogous to the side 80*a* of the flow block 64*a*. As a result, the valve 66*e* is in fluid communication with an internal region of the flow block 64*b* via a fluid passageway analogous to the fluid passageway 84*c* of the flow block 64*a*.

In some embodiments, the valves 66*a* and 66*b* are operably coupled to the flow block 64*a*, and the valves 66*c* and 66*d* are operably coupled to the flow block 64*b*, to reduce the number of fluid couplings, and thus potential leak paths, required to make up the choke module 36. In some embodiments, the manner in which the valves 66*a* and 66*b* are operably coupled to the flow block 64*a*, and the valves 66*c* and 66*d* are operably coupled to the flow block 64*b*, permits the drilling chokes 70*a* and 70*b* to be operably coupled in parallel between the flow blocks 64*a* and 64*b*. In some embodiments, the spacing between the valves 66*a* and 66*b* operably coupled to the flow block 64*a*, and the spacing between the valves 66*c* and 66*d* operably coupled to the flow block 64*b*, permit the drilling chokes 70*a* and 70*b* to be operably coupled in parallel between the flow blocks 64*a* and 64*b*.

Figure 9:
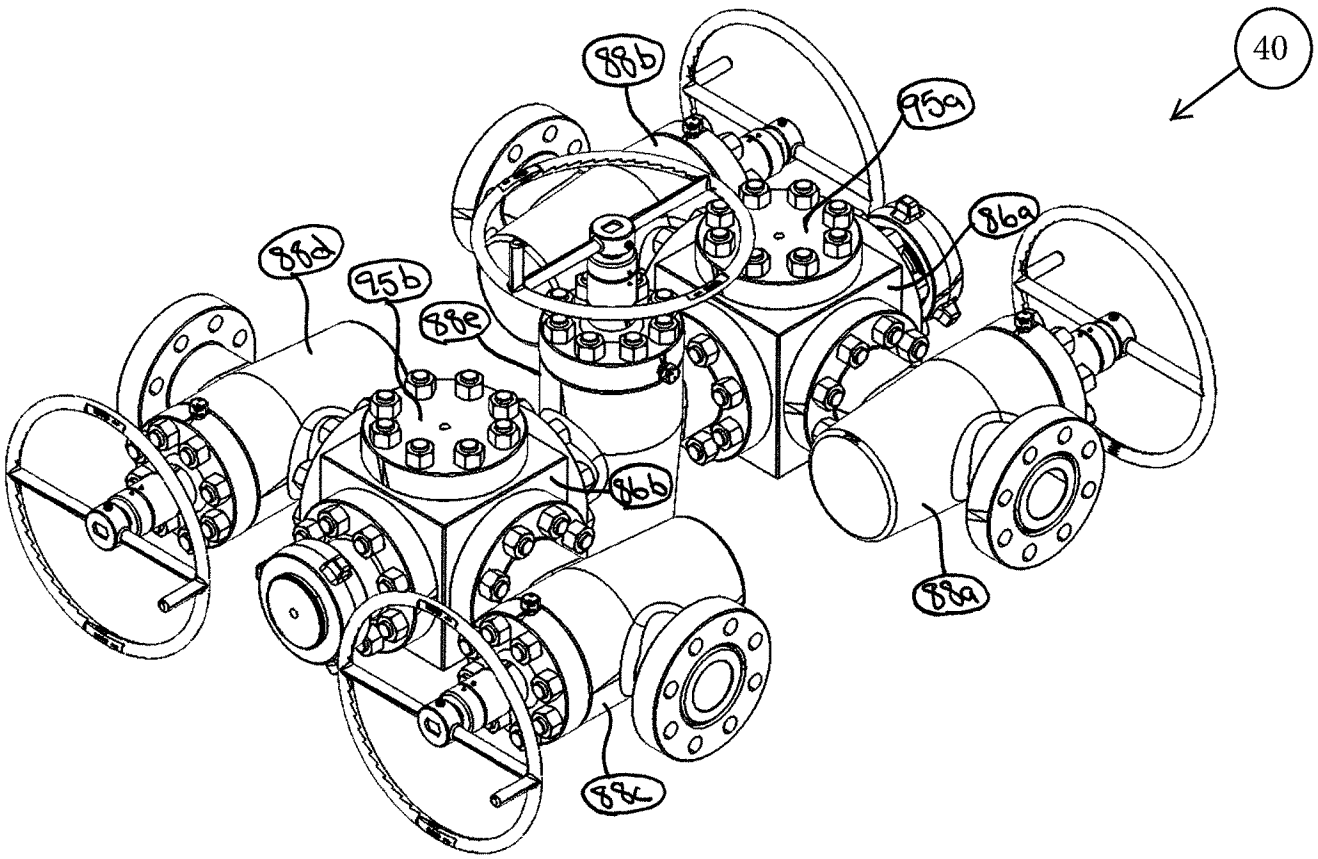
FIG. 9 is a perspective view of the valve module of FIG. 2, the valve module including a pair of flow blocks, according to an illustrative embodiment.
Figure 10:
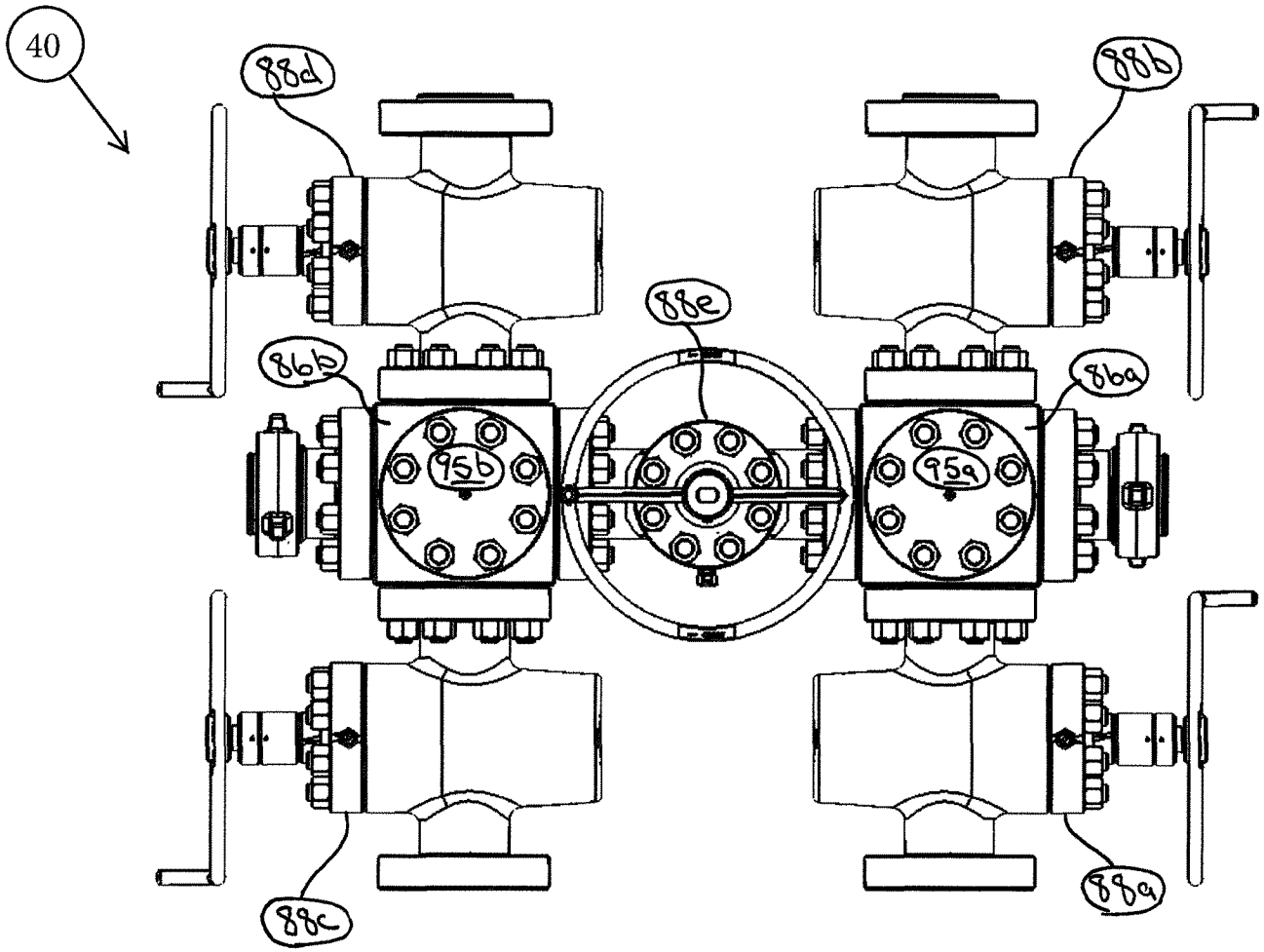
FIG. 10 is a top plan view of the valve module of FIG. 9, according to an illustrative embodiment.

In an illustrative embodiment, as depicted in FIGS. 9 and 10 with continuing reference to FIG. 2, the valve module 40 includes flow blocks 86*a-b* and valves 88*a-e*. The valves 88*a-e* are each actuable between an open position in which fluid flow is permitted therethrough, and a closed position in which fluid flow therethrough is prevented, or at least reduced. In some embodiments, the valves 88*a-e* are gate valves. Alternatively, one or more of the valves 88*a-e* may be another type of valve such as, for example, a plug valve. The valve 88*e* is operably coupled between the flow blocks 86*a* and 86*b*. The valve 88*a* is operably coupled to the flow block 86*a*. The valve 88*b* is operably coupled to the flow block 86*a*, opposite the valve 88*a*. The valve 88*c* is operably coupled to the flow block 86*b*. The valve 88*d* is operably coupled to the flow block 86*b*, opposite the valve 88*c*.

The valve module 40 is actuable between a flow metering configuration and a meter bypass configuration. In the flow metering configuration, the flow blocks 86*a* and 86*b* are in fluid communication via at least the valves 88*b* and 88*d* and the flow meter module 38, and are not in fluid communication via the valve 88*e*. In some embodiments, when the valve module 40 is in the flow metering configuration, the valves 88*a* and 88*e* are closed and the valves 88*b*, 88*c*, and 88*d* are open. In some embodiments, when the valve module is in the flow metering configuration, the valves 88*c* and 88*e* are closed and the valves 88*a*, 88*b*, and 88*d* are open. In the meter bypass configuration, the flow blocks 86*a* and 86*b* are in fluid communication via the valve 88*e*, and are not in fluid communication via the valves 88*b* and 88*d* and the flow meter module 38. In some embodiments, when the valve module 40 is in the meter bypass configuration, the valves 88*a*, 88*b*, and 88*d* are closed and the valves 88*c* and 88*e* are open. Alternatively, when the valve module 40 is in the meter bypass configuration, the valves 88*b*, 88*c*, and 88*d* are closed and the valves 88*a* and 88*e* are open.

Figure 11:
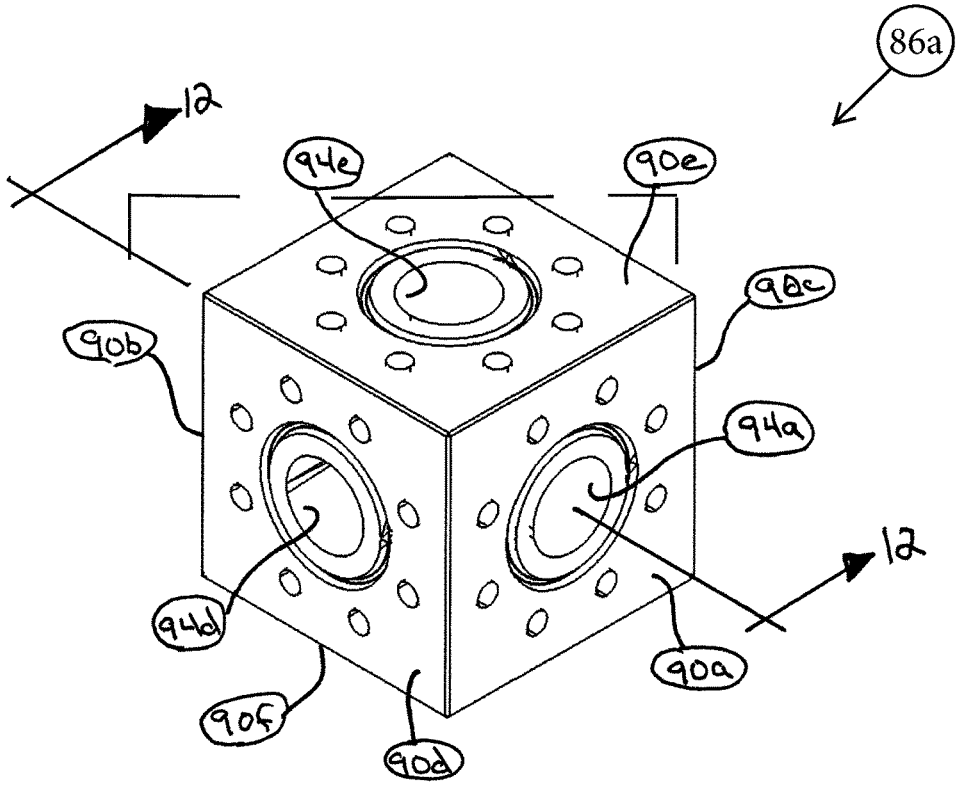
FIG. 11 is a perspective view of one of the flow blocks of FIGS. 9 and 10, according to an illustrative embodiment.
Figure 12:
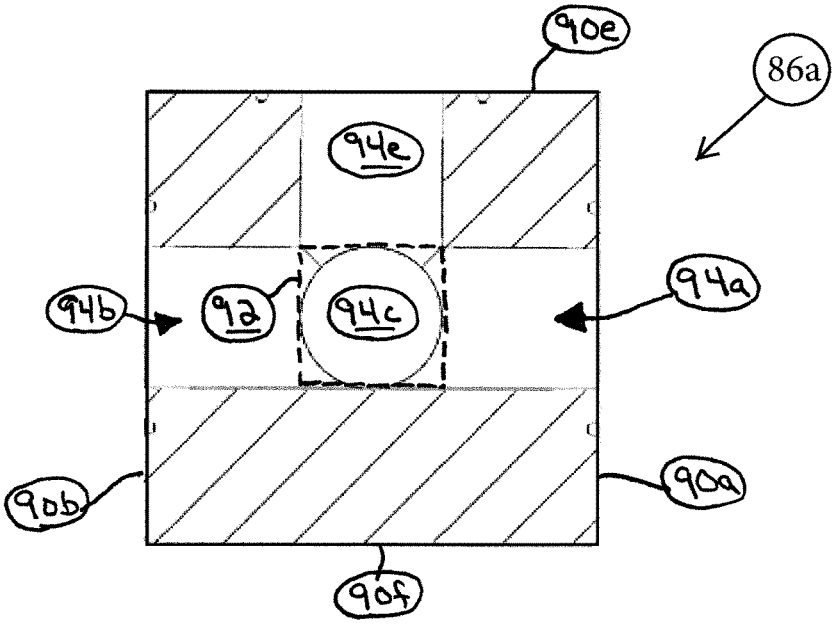
FIG. 12 is a cross-sectional view of the flow block of FIG. 11, taken along line 11-11 of FIG. 10, according to an illustrative embodiment.

In some embodiments, the flow blocks 86*a* and 86*b* are substantially identical to one another and, therefore, in connection with FIGS. 11 and 12, only the flow block 86*a* will be described in detail below; however, the description below applies to both of the flow blocks 86*a* and 86*b*. In an illustrative embodiment, as depicted in FIGS. 11 and 12 with continuing reference to FIGS. 9 and 10, the flow block 86*a* includes sides 90*a-f*. In some embodiments, the sides 90*a* and 90*b* are spaced in a substantially parallel relation. In some embodiments, the sides 90*c* and 90*d* are spaced in a substantially parallel relation, each extending from the side 90*a* to the side 90*b*. In some embodiments, the sides 90*e* and 90*f* are spaced in a substantially parallel relation, each extending from the side 90*a* to the side 90*b*. In some embodiments, one of which is shown in FIGS. 11 and 12, the sides 90*c* and 90*d* are spaced in a substantially parallel relation, and the sides 90*e* and 90*f* are spaced in a substantially parallel relation. In some embodiments, the sides 90*c* and 90*d* are spaced in a substantially perpendicular relation with the sides 90*e* and 90*f*. In some embodiments, the sides 90*a* and 90*b* are spaced in a substantially perpendicular relation with the sides 90*c* and 90*d*. In some embodiments, the sides 90*a* and 90*b* are spaced in a substantially perpendicular relation with the sides 90*e* and 90*f*. In some embodiments, one of which is shown in FIGS. 11 and 12, the sides 90*a* and 90*b* are spaced in a substantially perpendicular relation with the sides 90*c*, 90*d*, 90*e*, and 90*f*.

In addition, the flow block 86*a* defines an internal region 92 and fluid passageways 94*a-e*. In some embodiments, the fluid passageway 94*a* extends through the side 90*a* of the flow block 86*a* into the internal region 92. In some embodiments, the fluid passageway 94*b* extends through the side 90*b* of the flow block 86*a* into the internal region 92. In some embodiments, one of which shown in FIGS. 11 and 12, the fluid passageway 94*a* extends through the side 90*a* of the flow block 86*a* into the internal region 92, and the fluid passageway 94*b* extends through the side 90*b* of the flow block 86*a* into the internal region 92. In some embodiments, the fluid passageways 94*a* and 94*b* form a continuous fluid passageway together with the internal region 92. In some embodiments, the fluid passageway 94*c* extends through the side 90*c* of the flow block 86*a* into the internal region 92. In some embodiments, the fluid passageway 94*d* extends through the side 90*d* of the flow block 86*a* into the internal region 92. In some embodiments, one of which is shown in FIGS. 11 and 12, the fluid passageway 94*c* extends through the side 90*c* of the flow block 86*a* into the internal region 92, and the fluid passageway 94*d* extends through the side 90*d* of the flow block 86*a* into the internal region 92. In some embodiments, the fluid passageways 94*c* and 94*d* form a continuous fluid passageway together with the internal region 92. In some embodiments, one of which is shown in FIGS. 11 and 12, the fluid passageway 94*e* extends through the side 90*e* of the flow block 86*a* into the internal region 92.

Referring back to FIGS. 9 and 10, with continuing reference to FIGS. 11 and 12, it can be seen that the valve 88*a* is operably coupled to the side 90*a* of the flow block 86*a* and in fluid communication with the internal region 92 thereof via the fluid passageway 94*a*, and the valve 88*b* is operably coupled to the side 90*b* of the flow block 86*a* and in fluid communication with the internal region 92 thereof via the fluid passageway 94*b*. In some embodiments, a blind flange 95*a* is operably coupled to the side 90*e* of the flow block 86*a* to prevent communication between the internal region 92 and atmosphere. The valves 88*c* and 88*d* are operably coupled to the flow block 86*b* in substantially the same manner as the manner in which the valves 88*a* and 88*b* are operably coupled to the flow block 86*a*. In some embodiments, a blind flange 95*b* is operably coupled to the flow block 86*b* in substantially the same manner as the manner in which the blind flange 95*a* is operably coupled to the flow block 86*a*. The valve 88*e* is operably coupled to the side 90*d* of the flow block 86*a* and in fluid communication with the internal region 92 thereof via the fluid passageway 94*d*. Moreover, the valve 88*e* is operably coupled to the flow block 86*b* in substantially the same manner as the manner in which the valve 88*e* is operably coupled to the flow block 86*a*, except that the valve 88*e* is operably coupled to a side of the flow block 86*b* analogous to the side 90*c* of the flow block 86*a*. As a result, the valve 88*e* is in fluid communication with an internal region of the flow block 86*b* via a fluid passageway analogous to the fluid passageway 94*c* of the flow block 86*a*.

Figure 13:
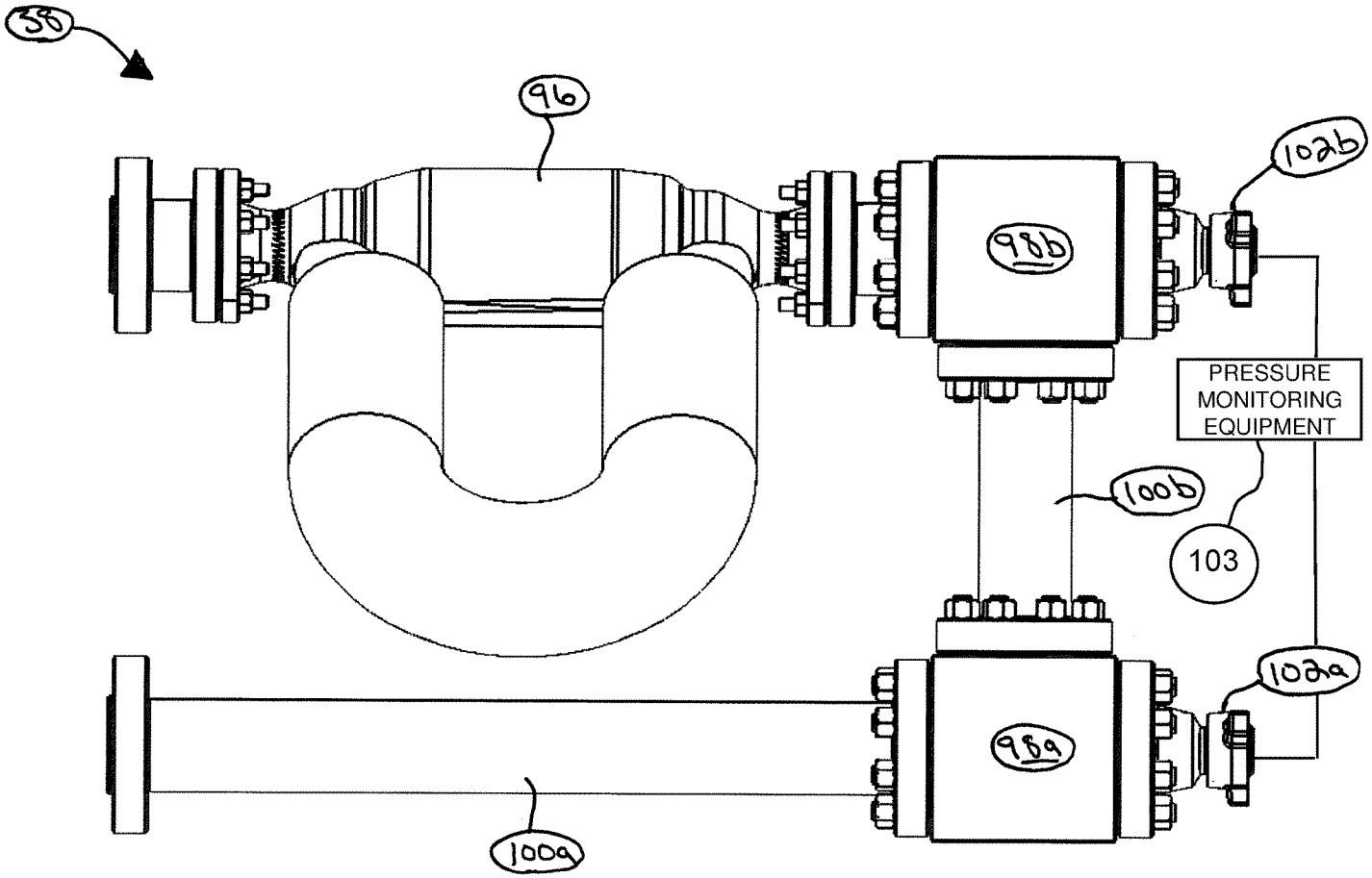
FIG. 13 is a top plan view of the flow meter module of FIG. 2, according to an illustrative embodiment.
Figure 14:
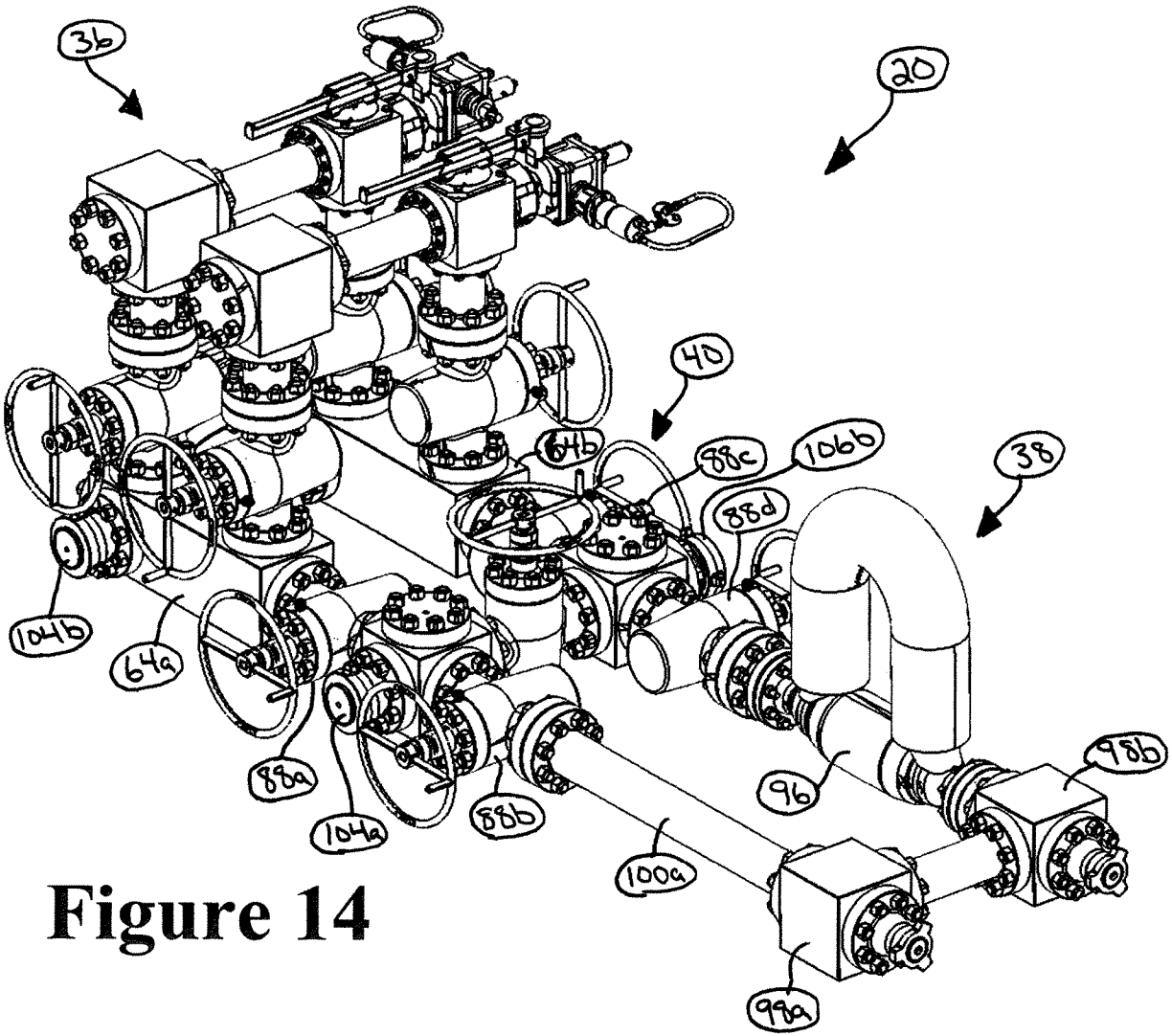
FIGS. 14-18 are front perspective, rear perspective, top plan, right side elevational, and left side elevational views, respectively, of the MPD manifold of FIGS. 1 and 2 incorporating the choke module of FIGS. 3-6, the valve module of FIGS. 9 and 10, and the flow meter module of FIG. 13, according to an illustrative embodiment.
Figure 15:
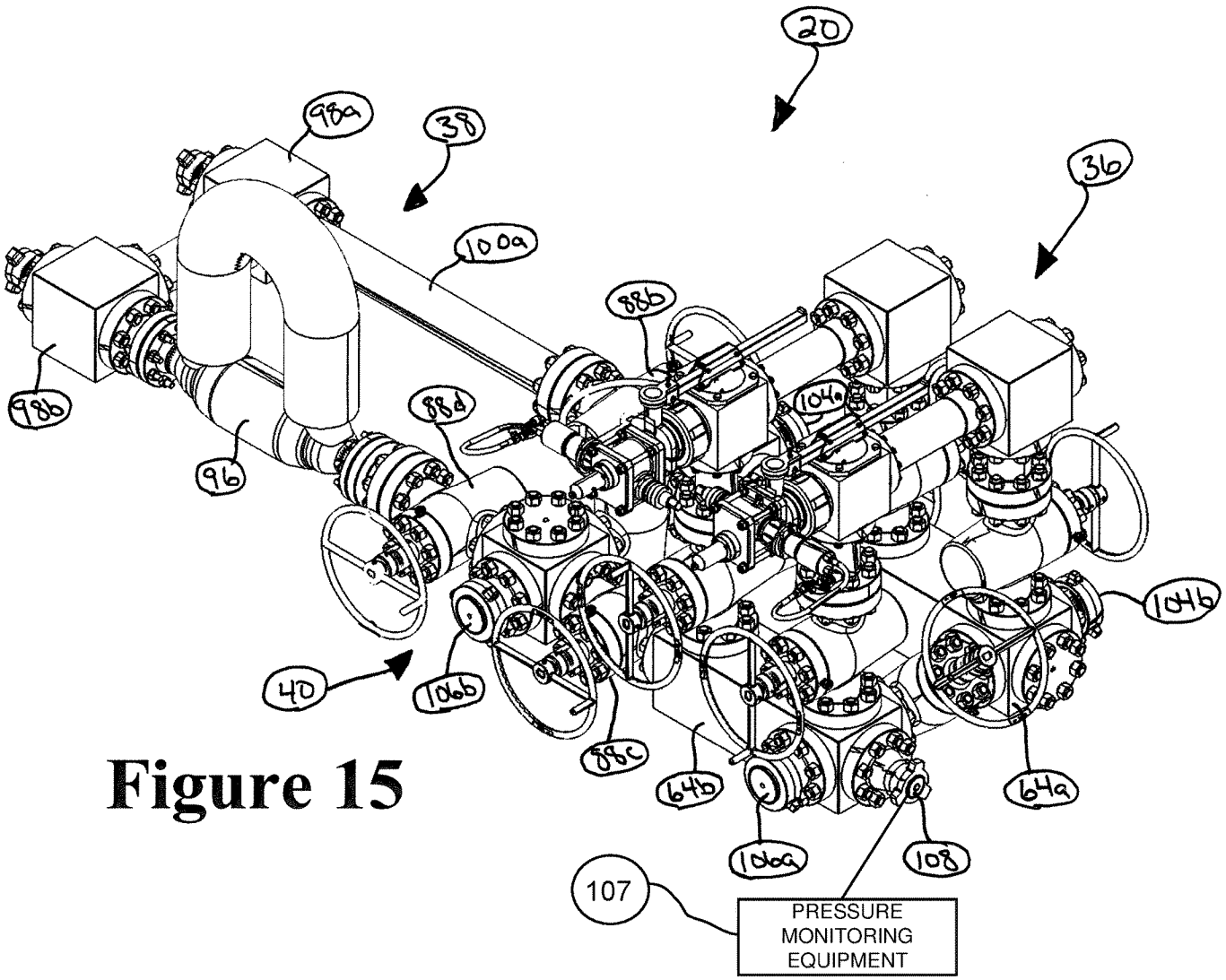
Figure 16:
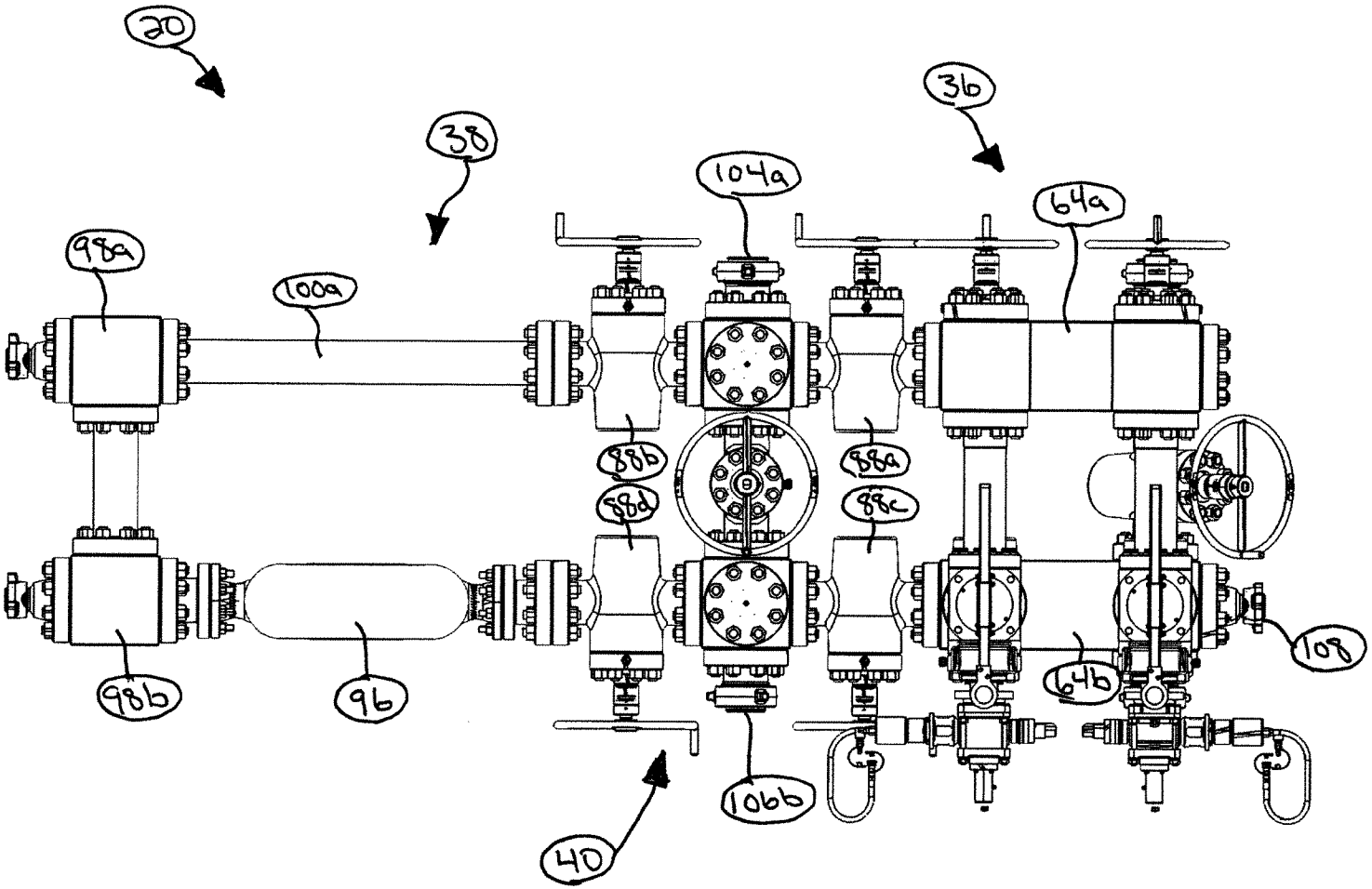
Figure 17:
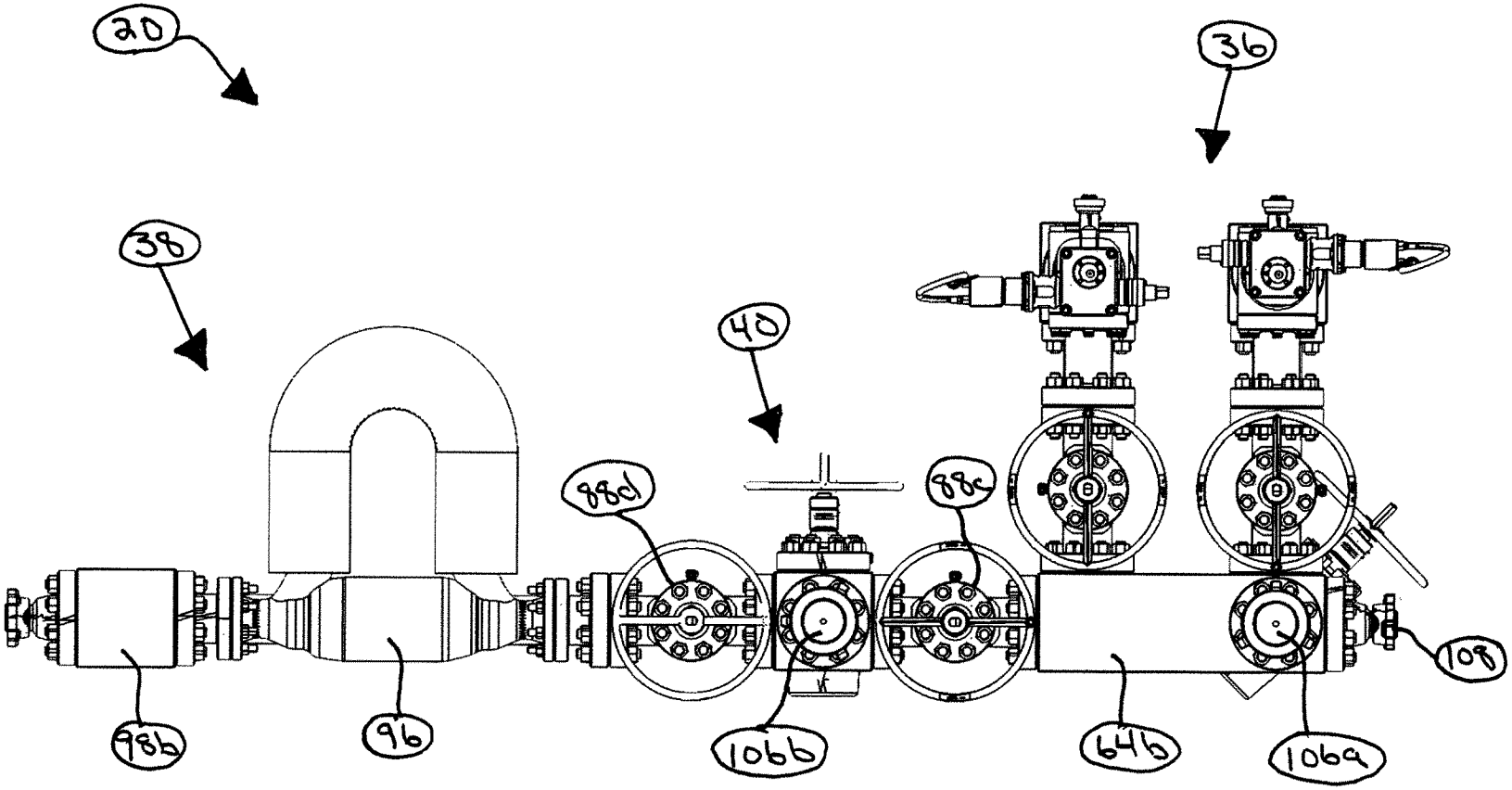
Figure 18:
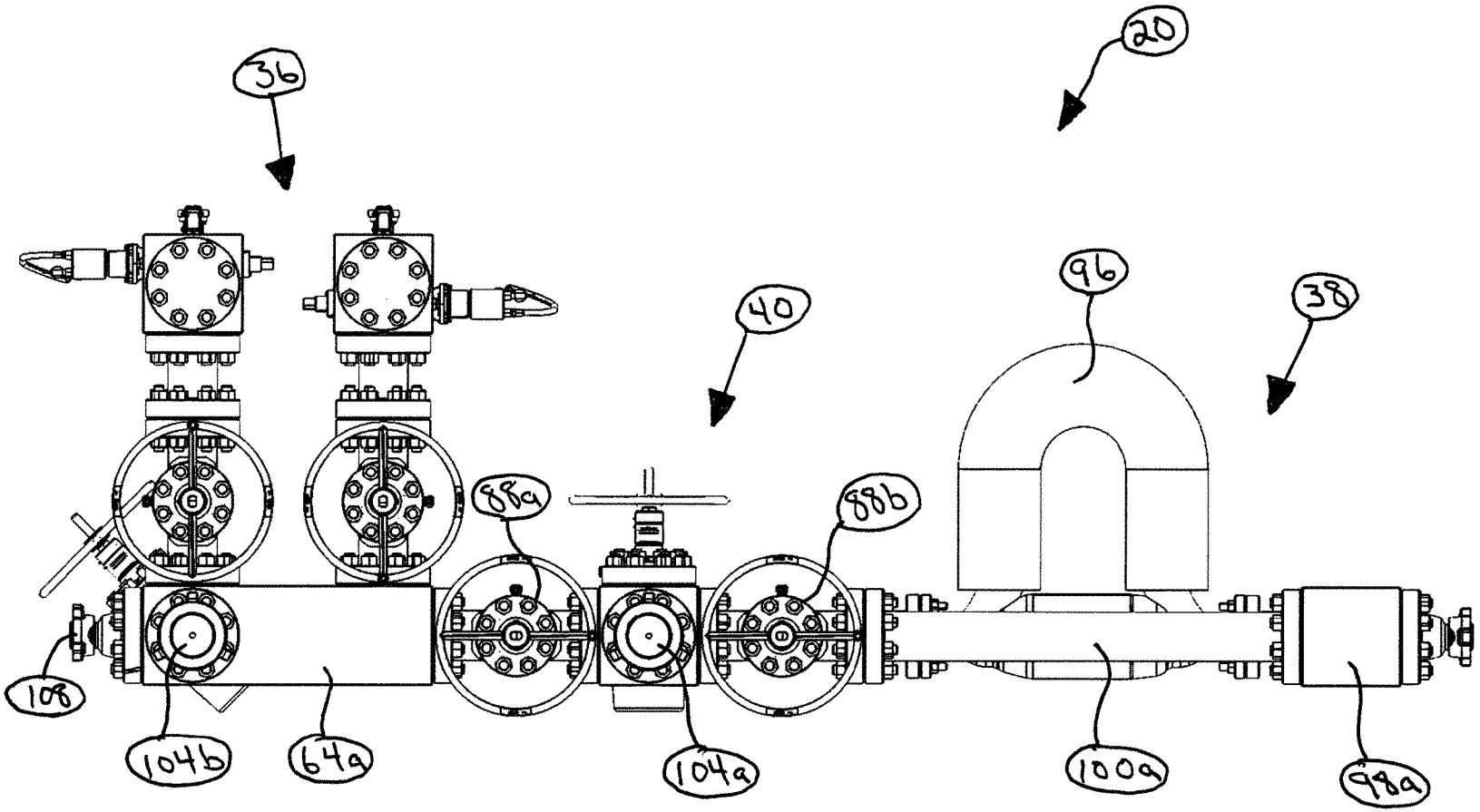

In an illustrative embodiment, as depicted in FIG. 13 with continuing reference to FIG. 2, the flow meter module 38 includes a flow meter 96, flow blocks 98*a-b*, and spools 100*a-b*. In some embodiments, the flow meter 96 is a coriolis flow meter. The spool 100*a* is operably coupled to, and in fluid communication with, the flow block 98*a*, and the flow meter 96 is operably coupled to, and in fluid communication with, the flow block 98*b*. Alternatively, the spool 100*a* may be operably coupled to, and in fluid communication with, the flow block 98*b*, and the flow meter 96 may be operably coupled to, and in fluid communication with, the flow block 98*a*. The spool 100*b* is operably coupled between, and in fluid communication with, the flow blocks 98*a* and 98*b*. In some embodiments, a measurement fitting 102*a* is operably coupled to the flow block 98*a*, opposite the spool 100*a*. In addition to, or instead of, the measurement fitting 102*a*, a measurement fitting 102*b* may be operably coupled to the flow block 98*b*, opposite the flow meter 96. In some embodiments, pressure monitoring equipment 103 such as, for example, electronic pressure monitoring equipment (including one or more pressure sensors) for automatically controlling one or both of the drilling chokes 70*a* and 70*b*, is operably coupled to one or both of the measurement fittings 102*a* and 102*b*. Instead of, or in addition to, the electronic pressure monitoring equipment, the pressure monitoring equipment 103 includes analog pressure monitoring equipment (including one or more pressure sensors), which may be operably coupled to one or both of the measurement fittings 102*a* and 102*b*.

In an illustrative embodiment, as depicted in FIGS. 14-18 with continuing reference to FIGS. 2-13, when the MPD manifold 20 is assembled, the valve module 40 is operably coupled between the choke module 36 and the flow meter module 38. More particularly, the valve 88*a* is operably coupled to the end 78*b* of the flow block 64*a* and in fluid communication with the internal region 82 thereof via the fluid passageway 84*b*, and the valve 88*c* is operably coupled to the flow block 64*b* in substantially the same manner as the manner in which the valve 88*a* is operably coupled to the flow block 64*a*. In addition, the valve 88*b* is operably coupled to the spool 100*a*, opposite the flow block 98*a*, and the valve 88*d* is operably coupled to the flow meter 96, opposite the flow block 98*b*. As a result, when the valve module 40 is operably coupled between the choke module 36 and the flow meter module 38, as shown in FIGS. 14-18, the flow meter module 38 extends in a generally horizontal orientation. In those embodiments in which the flow meter module 38 extends in the generally horizontal orientation, the MPD manifold 20 is especially well suited for use in on-shore drilling operations. In some embodiments, rather than the valve 88*b* being operably coupled to the spool 100*a* and the valve 88*d* being operably coupled to the flow meter 96, the valve 88*b* is operably coupled to the flow meter 96 and the valve 88*d* is operably coupled to the spool 100*a*.

Referring still to FIGS. 14-18, the MPD manifold 20 further includes a flow fitting 104*a* operably coupled to the side 90*c* of the flow block 86*a* and in fluid communication with the internal region 92 thereof via the fluid passageway 94*c*, and a flow fitting 104*b* operably coupled to the side 80*a* of the flow block 64*a* and in fluid communication with the internal region 82 thereof via the fluid passageway 84*c*. Further, in addition to, or instead of, the flow fitting 104*b*, the MPD manifold 20 may include a flow fitting 106*a* operably coupled to the flow block 64*b* in substantially the same manner as the manner in which the flow fitting 104*b* is operably coupled to the flow block 64*a*, except that the flow fitting 106*a* is operably coupled to a side of the flow block 64*b* analogous to the side 80*b* of the flow block 64*a*. Finally, in addition to, or instead of, the flow fitting 104*a*, the MPD manifold 20 may include a flow fitting 106*b* operably coupled to the flow block 86*b* in substantially the same manner as the manner in which the flow fitting 104*a* is operably coupled to the flow block 86*a*, except that the flow fitting 106*b* is operably coupled to a side of the flow block 86*b* analogous to the side 90*d* of the flow block 86*a*.

In those embodiments in which the MPD manifold 20 includes the flow fittings 104*a* and 104*b*, the temperature sensor 48 and the densometer 50 may be operably coupled to the valve module 40 (as shown in FIG. 2) via the flow fitting 104*a*, and the temperature sensor 44 and the densometer 46 may be operably coupled to the choke module 36 (as shown in FIG. 2) via the flow fitting 104*b*. In such embodiments, the flow fitting 104*a* is adapted to receive the drilling mud from the RCD 16 and the MGS 22 is adapted to receive the drilling mud from the flow fitting 104*b*. As a result, the drilling mud may be permitted to flow through the flow meter 96 before flowing through the drilling chokes 70*a* and/or 70*b*. Additionally, in those embodiments in which the MPD manifold 20 includes the flow fittings 106*a* and 106*b*, the temperature sensor 48 and the densometer 50 may be operably coupled to the choke module 36 (as shown in FIG. 26) via the flow fitting 106*a*, and the temperature sensor 44 and the densometer 46 may be operably coupled to the valve module 40 (as shown in FIG. 26) via the flow fitting 106*b*. In such embodiments, the flow fitting 106*a* is adapted to receive the drilling mud from the RCD 16 and the MGS 22 is adapted to receive the drilling mud from the flow fitting 106*b*, as described in further detail below with reference to FIG. 26. As a result, the drilling mud may be permitted to flow through the drilling chokes 70*a* and/or 70*b* before flowing through the flow meter 96.

In some embodiments, a measurement fitting 108 is operably coupled to the flow block 64*b* and in fluid communication with an internal region thereof via a fluid passageway analogous to the fluid passageway 84*a* of the flow block 64*a*. In addition to, or instead of, the measurement fitting 108, another measurement fitting (not shown) may be operably coupled to the end 78*a* of the flow block 64*a* and in fluid communication with the internal region 82 thereof via the fluid passageway 84*a*. In some embodiments, pressure monitoring equipment 107 (shown in FIG. 15) such as, for example, electronic pressure monitoring equipment (including one or more pressure sensors) for automatically controlling one or both of the drilling chokes 70*a* and 70*b*, is operably coupled to the measurement fitting 108 and/or the measurement fitting that is operably coupled to the flow block 64*a*. In addition to, or instead of, the electronic pressure monitoring equipment, the pressure monitoring equipment 107 includes analog pressure monitoring equipment (including one or more pressure sensors), which may be operably coupled to the measurement fitting 108 and/or the measurement fitting that is operably coupled to the flow block 64*a*.

Figure 19:
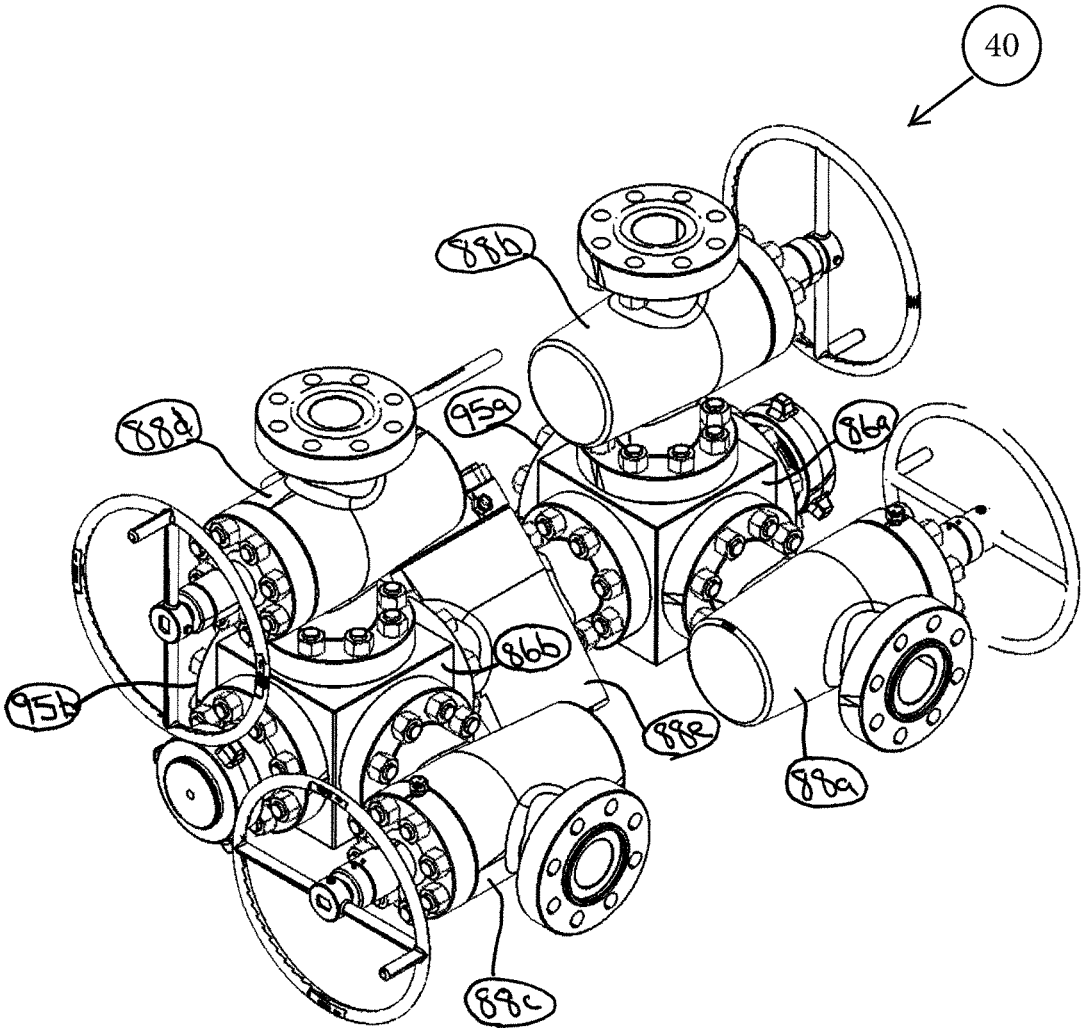
FIG. 19 is a perspective view of the valve module of FIG. 2, according to another illustrative embodiment.
Figure 20:
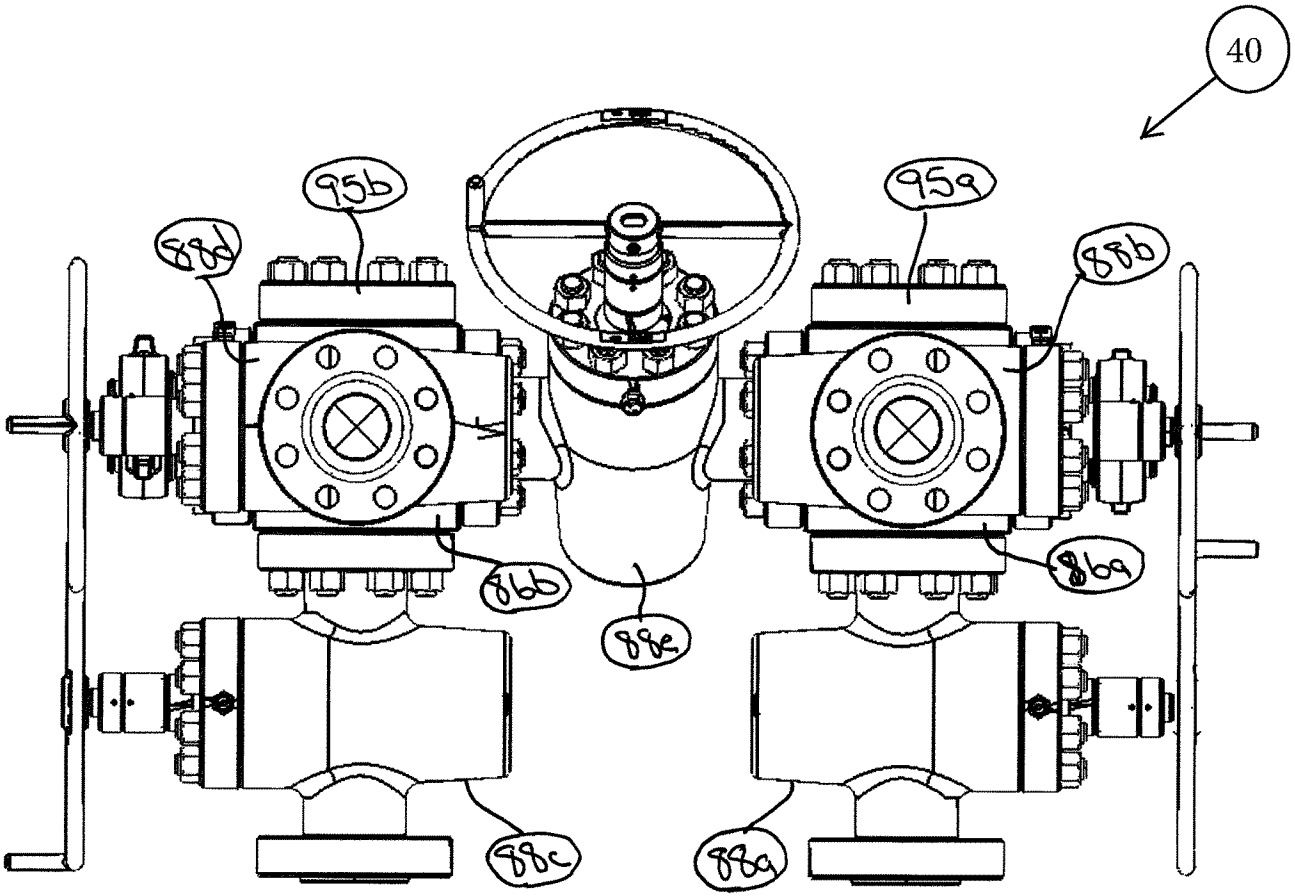
FIG. 20 is a top plan view of the valve module of FIG. 19, according to an illustrative embodiment.
Figure 21:
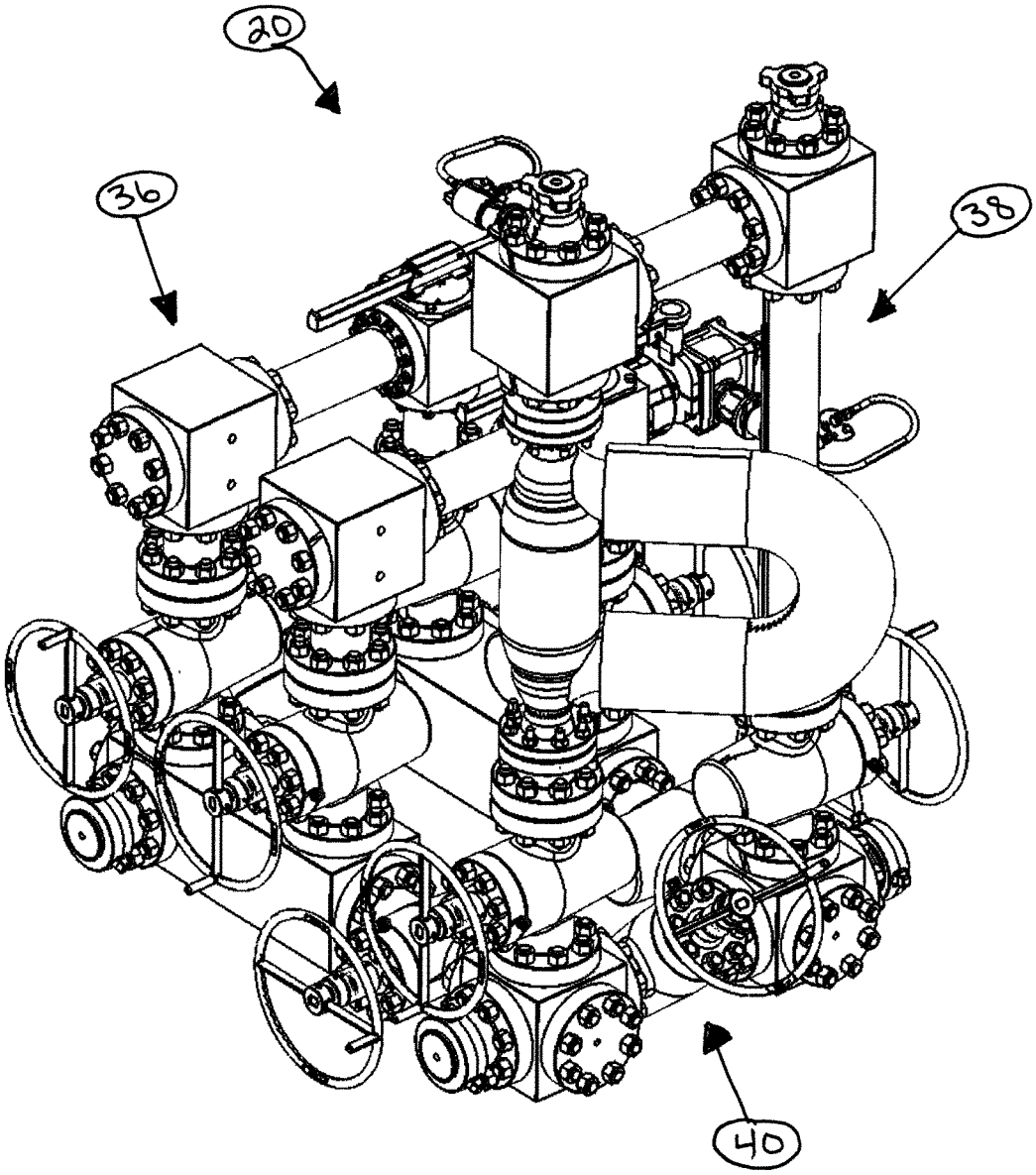
FIGS. 21-25 are front perspective, rear perspective, top plan, left side elevational, and right side elevational views, respectively, of the MPD manifold of FIGS. 1 and 2 incorporating the choke module of FIG. 3-6, the valve module of FIGS. 19 and 20, and the flow meter module of claim 13, according to an illustrative embodiment.
Figure 22:
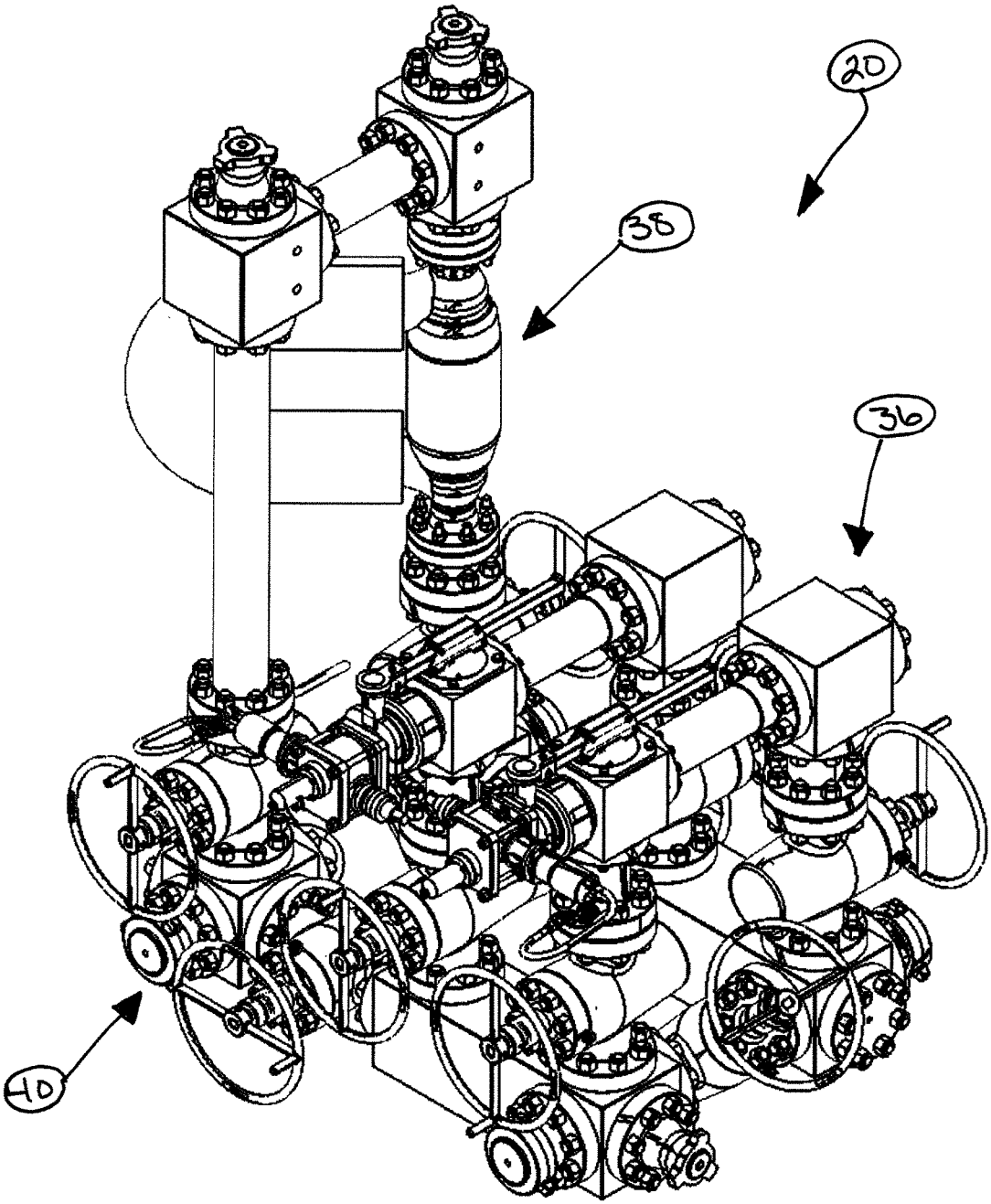
Figure 23:
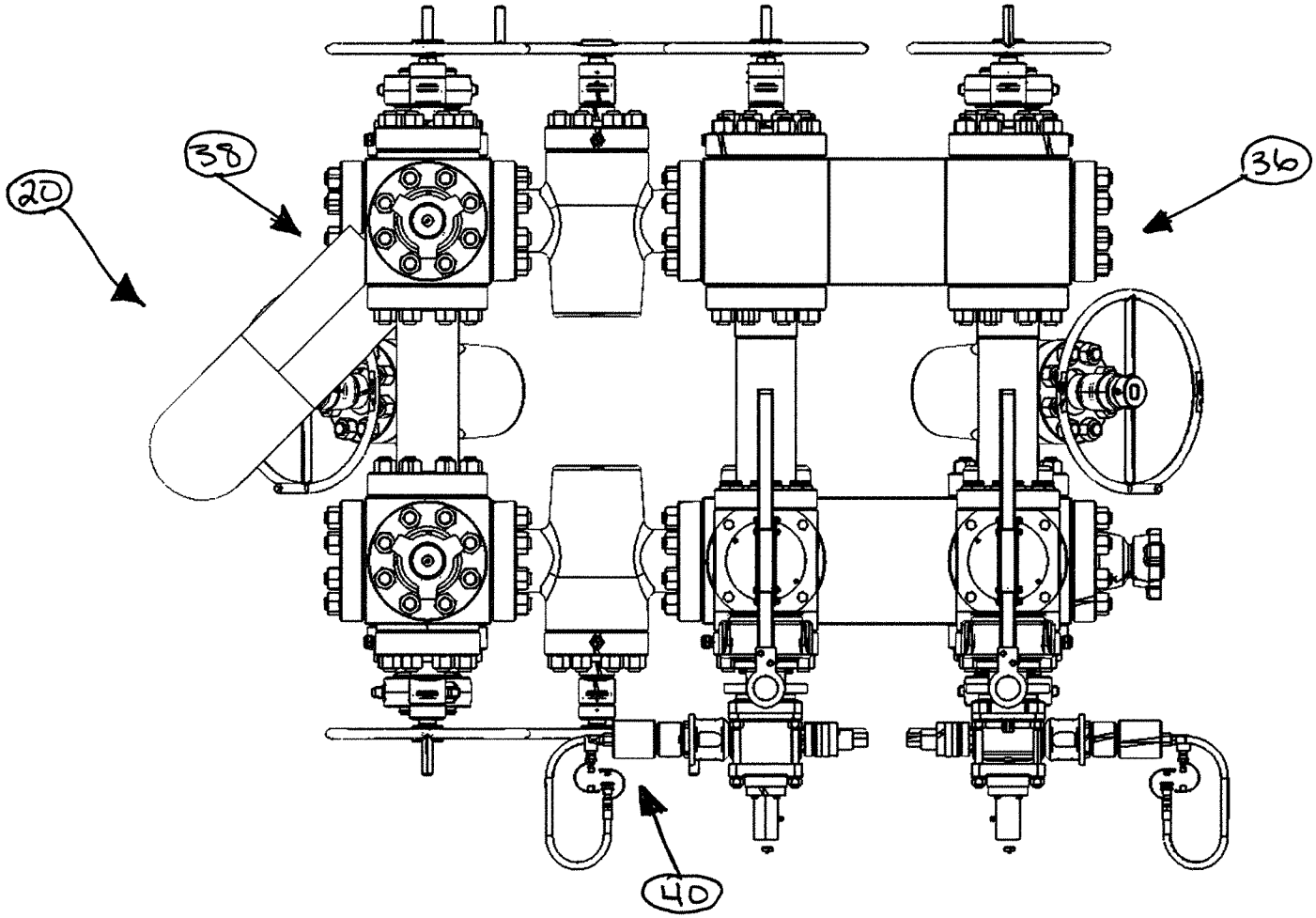
Figure 24:
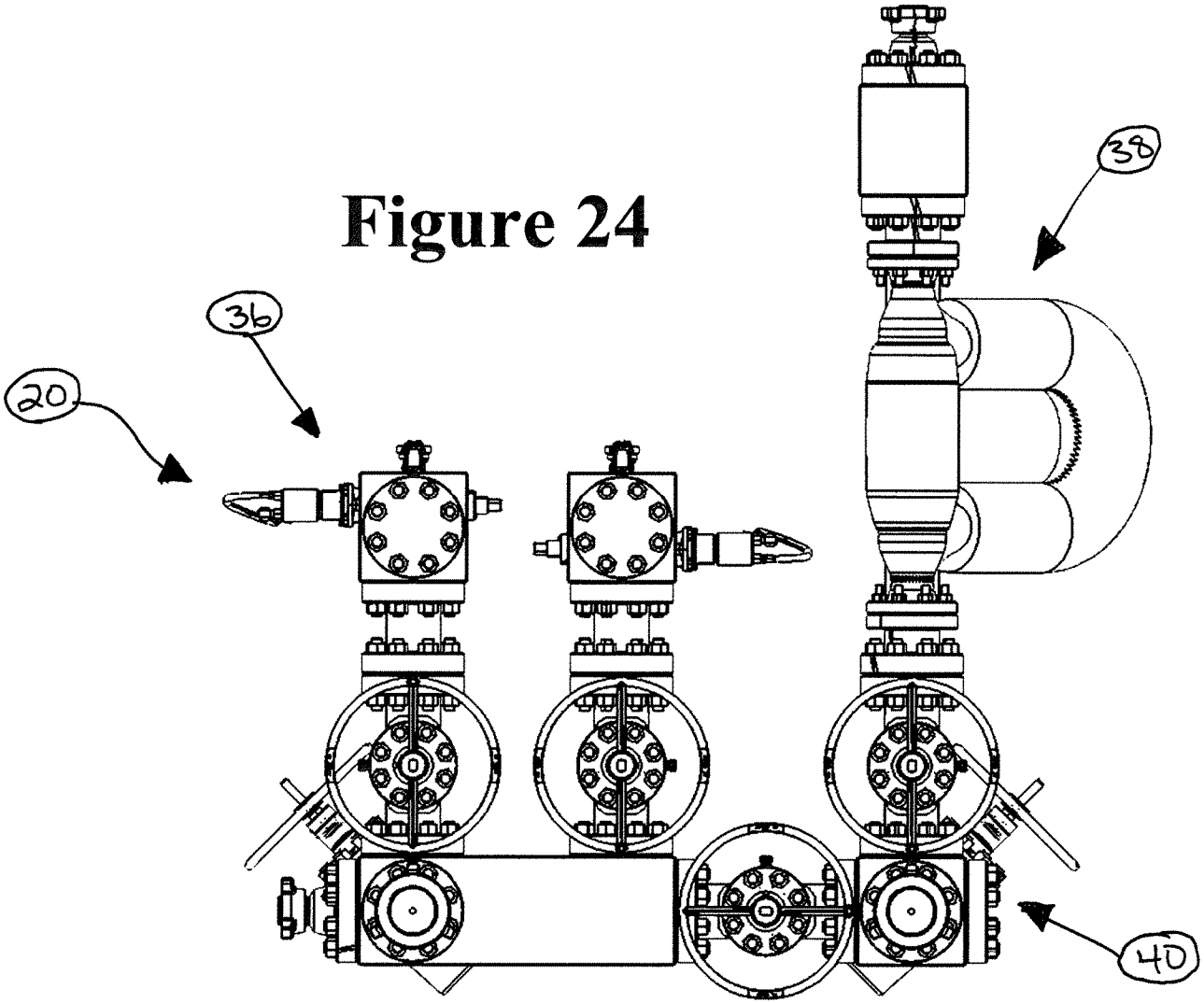
Figure 25:
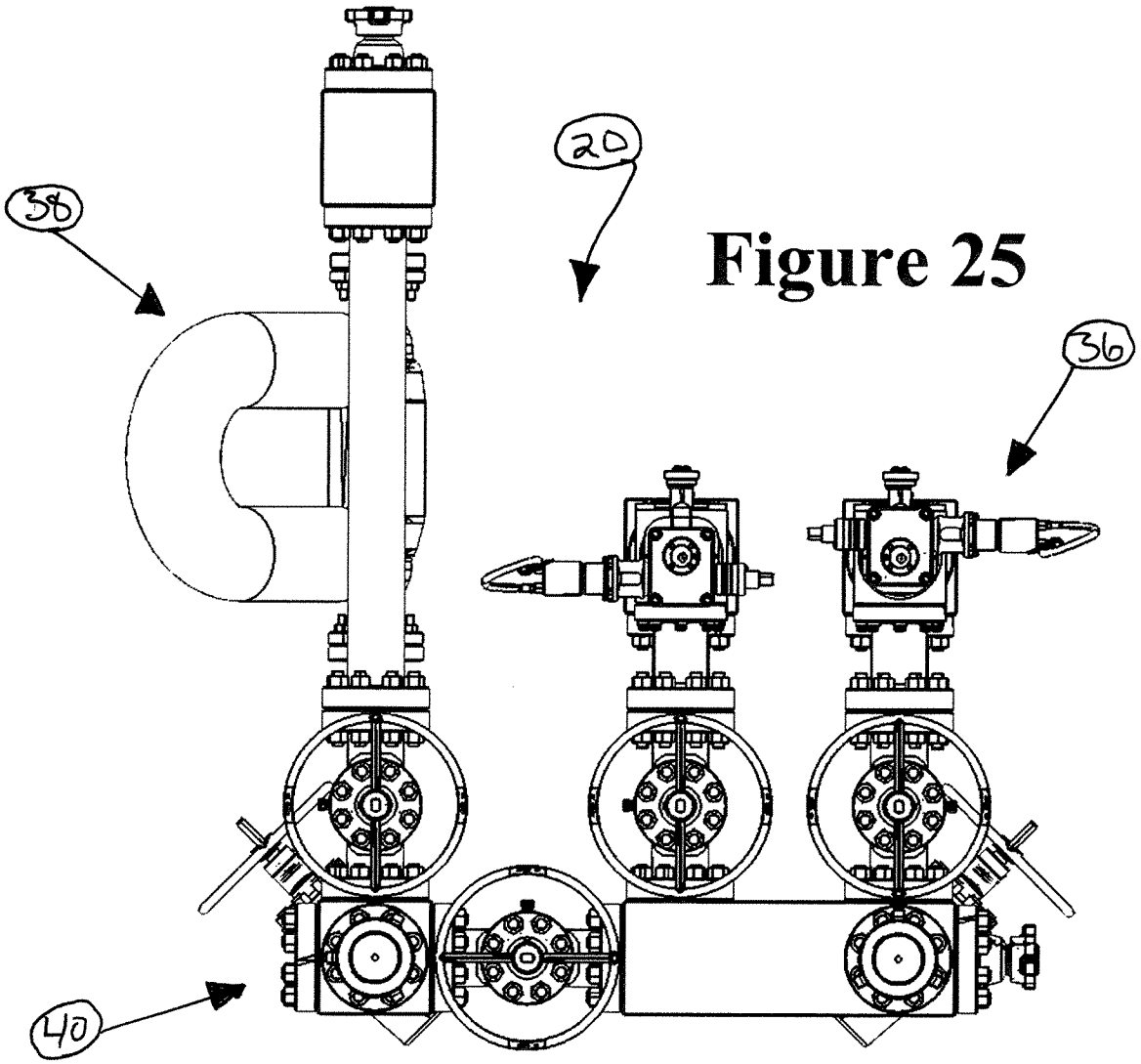

In an illustrative embodiment, as depicted in FIGS. 19 and 20 with continuing reference to FIGS. 9 and 10, the valve module 40 is configurable so that, rather than the valve 88*b* being operably coupled to the side 90*b* of the flow block 86*a* and in fluid communication with the internal region 92 thereof via the fluid passageway 94*b*, the valve 88*b* is operably coupled to the side 90*e* of the flow block 86*a* and in fluid communication with the internal region 92 thereof via the fluid passageway 94*e*. In addition, the valve 88*d* is operably coupled to the flow block 86*b* in substantially the same manner as the manner in which the valve 88*b* is operably coupled to the flow block 86*a*. As a result, when the valve module 40 is operably coupled between the choke module 36 and the flow meter module 38, as shown in FIGS. 21-25, the flow meter module 38 extends in a generally vertical orientation, thus significantly decreasing the overall footprint of the MPD manifold 20. In those embodiments in which the flow meter module 38 extends in the generally vertical orientation, the MPD manifold 20 is especially well suited for use in off-shore drilling operations. In some embodiments, the blind flange 95*a* is operably coupled to the side 90*b* of the flow block 86*a* to prevent communication between the internal region 92 and atmosphere. In some embodiments, the blind flange 95*b* is operably coupled to the flow block 86*b* in substantially the same manner as the manner in which the blind flange 95*a* is operably coupled to the flow block 86*a*.

Figure 26:
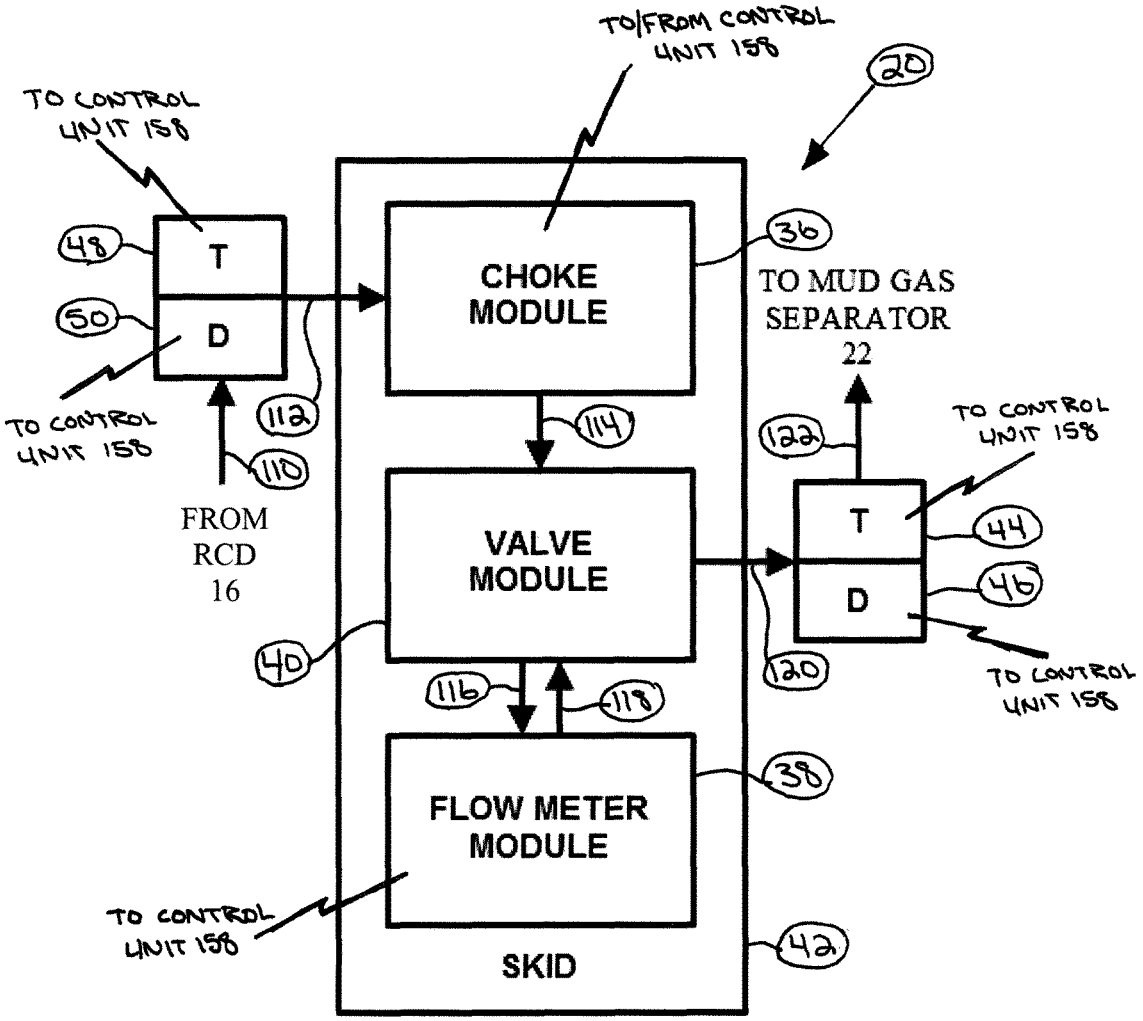
FIG. 26 is a diagrammatic view of the MPD manifold of FIG. 1, the MPD manifold including a choke module, a flow meter module, and a valve module, according to an illustrative embodiment.

In an illustrative embodiment, as depicted in FIG. 26 with continuing reference to FIG. 1, the MPD manifold 20 is configurable so that, rather than being operably coupled to the choke module 36, the temperature sensor 44 and the densometer 46 are operably coupled to the valve module 40. Additionally, the MPD manifold 20 is configurable so that, rather than being operably coupled to the valve module 40, the temperature sensor 48 and the densometer 50 are operably coupled to the choke module 36. In some embodiments, in addition to the choke module 36, the flow meter module 38, and the valve module 40 being together mounted to the skid 42, one or more of the temperature sensors 44 and 48, and the densometers 46 and 50 are also mounted to the skid 42.

During the operation of the drilling system 10, the choke module 36 receives drilling mud from the RCD 16, as indicated by arrows 110 and 112. The temperature sensor 48 measures the temperature of the drilling mud immediately before the drilling mud is received by the choke module 36. In addition, the densometer 50 measures the density of the drilling mud immediately before the drilling mud is received by the choke module 36. The choke module 36 is adjusted to maintain the desired backpressure of the drilling mud within the wellbore 29. The choke module 36 communicates the drilling mud to the valve module 40, as indicated by arrow 114. The valve module 40 routes the drilling mud from the choke module 36 to the flow meter module 38, as indicated by arrow 116. The flow meter module 38 measures the flow rate of the drilling mud before communicating the drilling mud back to the valve module 40, as indicated by arrow 118. The MGS 22 receives the drilling mud from the valve module 40, as indicated by arrows 120 and 122. The temperature sensor 44 measures the temperature of the drilling mud immediately after the drilling mud is discharged from the valve module 40. In addition, the densometer 46 measures the density of the drilling mud immediately after the drilling mud is discharged from the valve module 40.

In some embodiments, to determine the weight of the drilling mud: the temperature of the drilling mud measured by the temperature sensor 44 is compared with the temperature of the drilling mud measured by the temperature sensor 48; the density of the drilling mud measured by the densometer 46 is compared with the density of the drilling mud measured by the densometer 50; and/or the respective pressure(s) of the drilling mud measured by the pressure monitoring equipment 103 (shown in FIG. 13) operably coupled to the measurement fittings 102*a* and 102*b*, the pressure monitoring equipment 107 (shown in FIG. 15) operably coupled to the measurement fitting 108, pressure monitoring equipment operably coupled to another measurement fitting of the MPD manifold 20, or any combination thereof, are compared. Thus, the temperature sensors 44 and 48, the densometers 46 and 50, and/or the pressure monitoring equipment 103 and/or 107 are operable to determine whether the weight of the drilling mud is below a critical threshold. In some embodiments, in response to a determination that the weight of the drilling mud is below the critical threshold: the weight of the drilling fluid circulated to the drilling tool (as indicated by the arrows 30 and 32 in FIG. 1) is increased, and/or the drilling chokes 70*a* or 70*b* are adjusted to increase the backpressure of the drilling mud within the wellbore 29. In this manner, the temperature sensors 44 and 48, the densometers 46 and 50, and/or the pressure monitoring equipment 103 and/or 107 may be used to predict and prevent well kicks during drilling operations.

In some embodiments, to determine the amount of gas entrained in the drilling mud: the temperature of the drilling mud measured by the temperature sensor 44 is compared with the temperature of the drilling mud measured by the temperature sensor 48; the density of the drilling mud measured by the densometer 46 is compared with the density of the drilling mud measured by the densometer 50; and/or the respective pressure(s) of the drilling mud measured by the pressure monitoring equipment 103, the pressure monitoring equipment 107, pressure monitoring equipment operably coupled to another measurement fitting of the MPD manifold 20, or any combination thereof, are compared. Thus, the temperature sensors 44 and 48, the densometers 46 and 50, and/or the pressure monitoring equipment 103 and/or 107 are operable to determine whether the amount of gas entrained in the drilling mud is above a critical threshold. In some embodiments, in response to a determination that the amount of gas entrained in the drilling mud is above the critical threshold: the weight of the drilling fluid circulated to the drilling tool (as indicated by the arrows 30 and 32 in FIG. 1) is increased, and/or the drilling chokes 70*a* or 70*b* are adjusted to increase the backpressure of the drilling mud within the wellbore 29. In this manner, the temperature sensors 44 and 48, the densometers 46 and 50, and/or the pressure monitoring equipment 103 and/or 107 may be used to predict and prevent well kicks during drilling operations.

In some embodiments, the temperature and density of the drilling mud measured before the drilling mud passes through the drilling chokes 70*a* or 70*b* are compared with the temperature and density of the drilling mud after the drilling mud passes through the drilling chokes 70*a* or 70*b*. Further, in some embodiments, the temperature and pressure of the drilling mud measured before the drilling mud passes through the drilling chokes 70*a* or 70*b* are compared with the temperature and pressure of the drilling mud measured after the drilling mud passes through the drilling chokes 70*a* or 70*b*. Further still, in some embodiments, the density and pressure of the drilling mud measured before the drilling mud passes through the drilling chokes 70*a* or 70*b* are compared with the density and pressure of the drilling mud measured after the drilling mud passes through the drilling chokes 70*a* or 70*b*. Finally, in some embodiments, the temperature, density, and pressure of the drilling mud measured before the drilling mud passes through the drilling chokes 70*a* or 70*b* are compared with the temperature, density, and pressure of the drilling mud measured after the drilling mud passes through the drilling chokes 70*a* or 70*b*.

Figure 27:
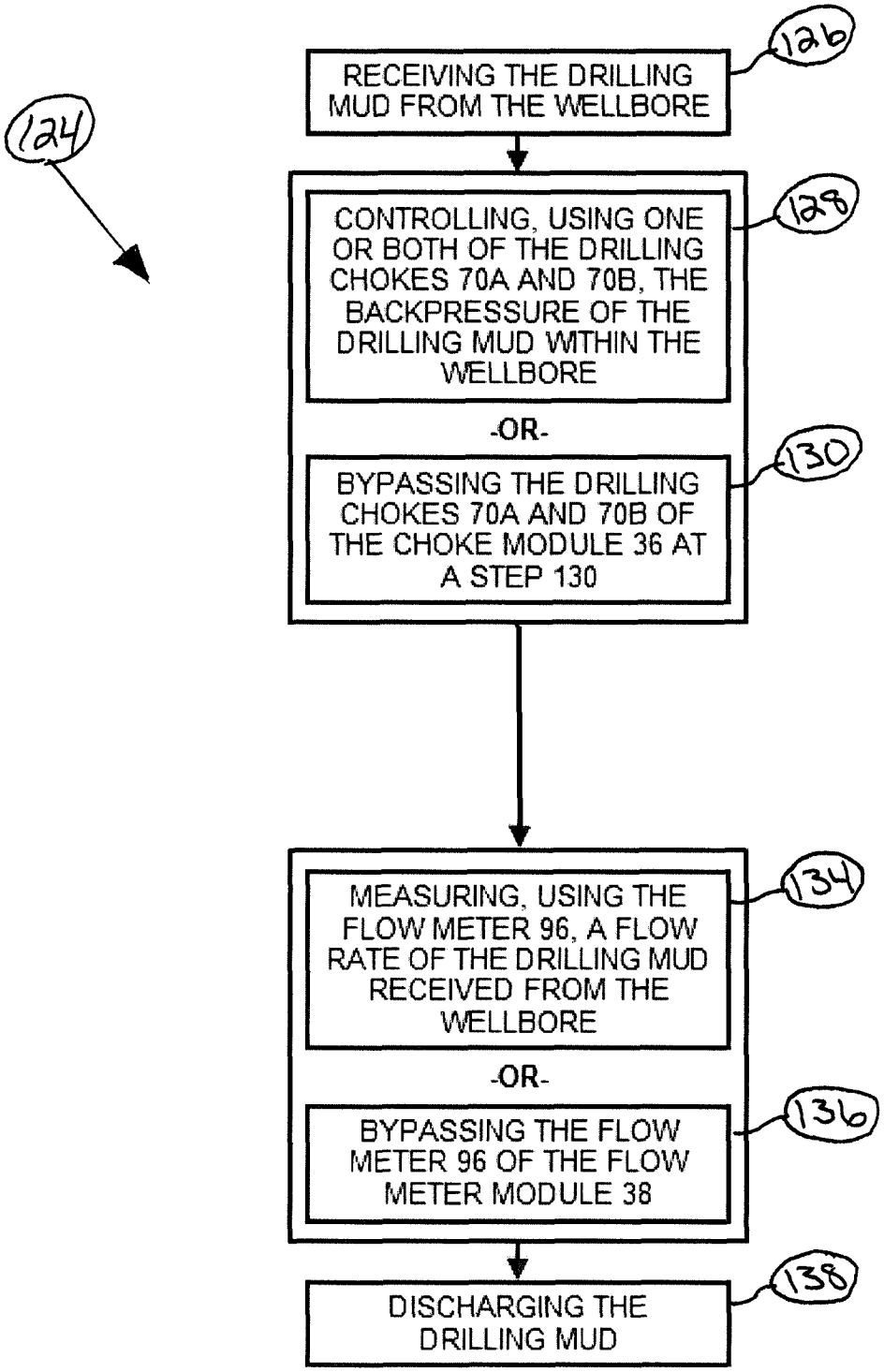
FIG. 27 is a flow chart illustration of a method of controlling backpressure of a drilling mud within a wellbore, according to an illustrative embodiment.

In an illustrative embodiment, as depicted in FIG. 27, with continuing reference to FIGS. 1-26, a method of controlling backpressure of a drilling mud within a wellbore is generally referred to by the reference numeral 124. The method 124 includes receiving the drilling mud from the wellbore at a step 126; either: controlling, using one or both of the drilling chokes 70*a* and 70*b*, the backpressure of the drilling mud within the wellbore at a step 128, the drilling chokes 70*a* and 70*b* being part of the choke module 36, or bypassing the drilling chokes 70*a* and 70*b* of the choke module 36 at a step 130; either: measuring, using the flow meter 96, a flow rate of the drilling mud received from the wellbore at a step 134, the flow meter 96 being part of the flow meter module 38, or bypassing the flow meter 96 of the flow meter module 38 at a step 136; and discharging the drilling mud at a step 138.

In some embodiments, the drilling mud is received from the wellbore at the step 126. In an illustrative embodiment of the step 126, the drilling mud is received from the wellbore via the flow fitting 104*a* operably coupled to, and in fluid communication with, the internal region 92 of the flow block 86*a* via the fluid passageway 94*c* thereof. In another illustrative embodiment of the step 126, the drilling mud is received from the wellbore via the flow fitting 106*a* operably coupled to the flow block 64*b* in substantially the same manner as the manner in which the flow fitting 104*b* is operably coupled to the flow block 64*a*, except that the flow fitting 106*a* is operably coupled to a side of the flow block 64*b* analogous to the side 80*b* of the flow block 64*a*.

In some embodiments, one or both of the drilling chokes 70*a* and 70*b* control the backpressure of the drilling mud within the wellbore at the step 128. In an illustrative embodiment of the step 128, one or both of the drilling chokes 70*a* and 70*b* are used to control the backpressure of the drilling mud within the wellbore by: permitting fluid flow from the flow block 64*b* to the flow block 64*a* via one or both of the following element combinations: the valve 66*a*, the drilling choke 70*a*, and the valve 66*c*; and the valve 66*b*, the drilling choke 70*b*, and the valve 66*d*; and preventing, or at least reducing, fluid flow from the flow block 64*b* to the flow block 64*a* via the valve 66*e*. More particularly, one or both of the drilling chokes 70*a* and 70*b* may be used to control the backpressure of the drilling mud within the wellbore by actuating the valves 66*a-e* so that: the valves 66*a* and 66*c* are open and the valves 66*b*, 66*d*, and 66*e* are closed; the valves 66*b* and 66*d* are open and the valves 66*a*, 66*c*, and 66*e* are closed; or the valves 66*a-d* are open and the valve 66*e* is closed.

In some embodiments, the drilling chokes 70*a* and 70*b* are bypassed at the step 130. In an illustrative embodiment of the step 130, the drilling chokes 70*a* and 70*b* of the choke module 36 are bypassed by: permitting fluid flow from the flow block 64*b* to the flow block 64*a* via the valve 66*e*; and preventing, or at least reducing, fluid flow from the flow block 64*b* to the flow block 64*a* via each of the following element combinations: the valve 66*a*, the drilling choke 70*a*, and the valve 66*c*; and the valve 66*b*, the drilling choke 70*b*, and the valve 66*d*. More particularly, the drilling chokes 70*a* and 70*b* of the choke module 36 are bypassed by actuating the valves 66*a-e* so that: the valves 66*a-d* are closed and the valve 66*e* is open.

In some embodiments, to measure the flow rate of the drilling fluid at the step 134, the valve module 40 is used to communicate the drilling mud to the flow meter module 38. In an illustrative embodiment, the valve module 40 is used to communicate the drilling mud to the flow meter module 38 by: permitting fluid flow from the flow block 86*a* to the flow block 86*b* via the valve 88*b*, the flow meter 96, and the valve 88*d*; and preventing, or at least reducing, fluid flow from the flow block 86*a* to the flow block 86*b* via the valve 88*e*. More particularly, the valve module 40 may be used to communicate the drilling mud to the flow meter module 38 by actuating the valves 88*a-e* so that either: the valves 88*b*, 88*c*, and 88*d* are open and the valves 88*a* and 88*e* are closed; or the valves 88*a*, 88*b*, and 88*d* are open and the valves 88*c* and 88*e* are closed.

In an illustrative embodiment of the step 134, the drilling mud flows from the valve 88*b*, through the spool 100*a*, the flow block 98*a*, the spool 100*b*, the flow block 98*b*, and the flow meter 96, and into the valve 88*d*. During the flow of the drilling mud through the flow meter 96, the flow meter 96 measures the flow rate of the drilling mud. In some embodiments, the flow meter 96 is a coriolis flow meter.

In some embodiments, the flow meter 96 of the flow meter module 38 is bypassed at the step 136. In an illustrative embodiment of the step 136, the flow meter 96 of the flow meter module 38 is bypassed by preventing, or at least reducing, fluid flow from the flow block 86*a* to the flow block 86*b* via the valve 88*b*, the flow meter 96, and the valve 88*d*; and permitting fluid flow from the flow block 86*a* to the flow block 86*b* via the valve 88*e*. More particularly, the flow meter 96 of the flow meter module 38 may be bypassed by actuating the valves 66*a-e* so that either: the valves 88*c* and 88*e* are open and the valves 88*a*, 88*b*, and 88*d* are closed; or the valves 88*a* and 88*e* are open and the valves 88*b*, 88*c*, and 88*d* are closed.

In some embodiments, the method 124 includes discharging the drilling mud at the step 138. In an illustrative embodiment of the step 138, the drilling mud is discharged via either: the flow fitting 104*b* operably coupled to, and in fluid communication with, the internal region 82 of the flow block 64*a* via the fluid passageway 84*c* thereof; or the flow fitting 106*b* operably coupled to the flow block 86*b* in substantially the same manner as the manner in which the flow fitting 104*a* is operably coupled to the flow block 86*a*, except that the flow fitting 106*b* is operably coupled to a side of the flow block 86*b* analogous to the side 90*d* of the flow block 86*a*.

In an illustrative embodiment of the steps 126 and 138, at the step 126 the drilling mud is received from the wellbore via the flow fitting 104*a* operably coupled to, and in fluid communication with, the internal region 92 of the flow block 86*a* via the fluid passageway 94*c* thereof, and at the step 138 the drilling mud is discharged via the flow fitting 104*b* operably coupled to, and in fluid communication with, the internal region 82 of the flow block 64*a* via the fluid passageway 84*c* thereof. In another illustrative embodiment of the steps 126 and 138, at the step 126 the drilling mud is received from the wellbore via the flow fitting 106*a* operably coupled to the flow block 64*b* in substantially the same manner as the manner in which the flow fitting 104*b* is operably coupled to the flow block 64*a*, and at the step 138 the drilling mud is discharged via the flow fitting 106*b* operably coupled to the flow block 86*b* in substantially the same manner as the manner in which the flow fitting 104*a* is operably coupled to the flow block 86*a*.

In several illustrative embodiments, the steps of the method 124 may be executed with different combinations of steps in different orders and/or ways. For example, an illustrative embodiment of the method 124 includes: the step 126 at which drilling mud is received from the wellbore via the flow fitting 104*a* operably coupled to, and in fluid communication with, the internal region 92 of the flow block 86*a* via the fluid passageway 94*c* thereof; during and/or after the step 126, the step 134 at which the drilling mud flows from the flow block 86*a* to the flow block 86*b* via the valve 88*b*, the spool 100*a*, the flow block 98*a*, the spool 100*b*, the flow block 98*b*, the flow meter 96, and the valve 88*d* (the valves 88*a* and 88*e* are closed); during and/or after the step 134, the step 128 at which the drilling mud flows from the flow block 86*b* to the flow block 64*b* via the valve 88*c*, and from the flow block 64*b* to the flow block 64*a* via one or both of the following element combinations: the valve 66*c*, the drilling choke 70*a*, and the valve 66*a*; and the valve 66*d*, the drilling choke 70*b*, and the valve 66*b* (the valve 66*e* is closed); during and/or after the step 128, the step 138 at which the drilling mud is discharged via the flow fitting 104*b* operably coupled to, and in fluid communication with, the internal region 82 of the flow block 64*a* via the fluid passageway 84*c* thereof.

For another example, an illustrative embodiment of the method 124 includes: the step 126 at which drilling mud is received from the wellbore via the flow fitting 104*a* operably coupled to, and in fluid communication with, the internal region 92 of the flow block 86*a* via the fluid passageway 94*c* thereof; during and/or after the step 126, the step 136 at which the drilling mud flows from the flow block 86*a* to the flow block 86*b* via the valve 88*e* (the valves 88*a*, 88*b*, and 88*d* are closed); during and/or after the step 136, the step 128 at which the drilling mud flows from the flow block 86*b* to the flow block 64*b* via the valve 88*c*, and from the flow block 64*b* to the flow block 64*a* via one or both of the following element combinations: the valve 66*c*, the drilling choke 70*a*, and the valve 66*a*; and the valve 66*d*, the drilling choke 70*b*, and the valve 66*b* (the valve 66*e* is closed); during and/or after the step 128, the step 138 at which the drilling mud is discharged via the flow fitting 104*b* operably coupled to, and in fluid communication with, the internal region 82 of the flow block 64*a* via the fluid passageway 84*c* thereof.

For yet another example, an illustrative embodiment of the method 124 includes: the step 126 at which drilling mud is received from the wellbore via the flow fitting 104*a* operably coupled to, and in fluid communication with, the internal region 92 of the flow block 86*a* via the fluid passageway 94*c* thereof; during and/or after the step 126, the step 134 at which the drilling mud flows from the flow block 86*a* to the flow block 86*b* via the valve 88*b*, the spool 100*a*, the flow block 98*a*, the spool 100*b*, the flow block 98*b*, the flow meter 96, and the valve 88*d* (the valves 88*a* and 88*e* are closed); during and/or after the step 134, the step 130 at which the drilling mud flows from the flow block 86*b* to the flow block 64*b* via the valve 88*c*, and from the flow block 64*b* to the flow block 64*a* via the valve 66*e* (the valves 66*c* and 66*d* are closed); during and/or after the step 130, the step 138 at which the drilling mud is discharged via the flow fitting 104*b* operably coupled to, and in fluid communication with, the internal region 82 of the flow block 64*a* via the fluid passageway 84*c* thereof.

For yet another example, an illustrative embodiment of the method 124 includes: the step 126 at which drilling mud is received from the wellbore via the flow fitting 104*a* operably coupled to, and in fluid communication with, the internal region 92 of the flow block 86*a* via the fluid passageway 94*c* thereof; during and/or after the step 126, the step 136 at which the drilling mud flows from the flow block 86*a* to the flow block 86*b* via the valve 88*e* (the valves 88*a*, 88*b*, and 88*d* are closed); during and/or after the step 136, the step 130 at which the drilling mud flows from the flow block 86*b* to the flow block 64*b* via the valve 88*c*, and from the flow block 64*b* to the flow block 64*a* via the valve 66*e* (the valves 66*c* and 66*d* are closed); during and/or after the step 130, the step 138 at which the drilling mud is discharged via the flow fitting 104*b* operably coupled to, and in fluid communication with, the internal region 82 of the flow block 64*a* via the fluid passageway 84*c* thereof.

For yet another example, an illustrative embodiment of the method 124 includes: the step 126 at which the drilling mud is received from the wellbore via the flow fitting 106*a* operably coupled to the flow block 64*b* in substantially the same manner as the manner in which the flow fitting 104*b* is operably coupled to the flow block 64*a*; during and/or after the step 126, the step 128 at which the drilling mud flows from the flow block 64*b* to the flow block 64*a* via one or both of the following element combinations: the valve 66*c*, the drilling choke 70*a*, and the valve 66*a*; and the valve 66*d*, the drilling choke 70*b*, and the valve 66*b* (the valve 66*e* is closed); during and/or after the step 128, the step 134 at which the drilling mud flows from the flow block 64*a* to the flow block 86*a* via the valve 88*a*, and from the flow block 86*a* to the flow block 86*b* via the valve 88*b*, the spool 100*a*, the flow block 98*a*, the spool 100*b*, the flow block 98*b*, the flow meter 96, and the valve 88*d* (the valves 88*c* and 88*e* are closed); during and/or after the step 134, the step 138 at which the drilling mud is discharged via the flow fitting 106*b* operably coupled to the flow block 86*b* in substantially the same manner as the manner in which the flow fitting 104*a* is operably coupled to the flow block 86*a*.

For yet another example, an illustrative embodiment of the method 124 includes: the step 126 at which the drilling mud is received from the wellbore via the flow fitting 106*a* operably coupled to the flow block 64*b* in substantially the same manner as the manner in which the flow fitting 104*b* is operably coupled to the flow block 64*a*; during and/or after the step 126, the step 128 at which the drilling mud flows from the flow block 64*b* to the flow block 64*a* via one or both of the following element combinations: the valve 66*c*, the drilling choke 70*a*, and the valve 66*a*; and the valve 66*d*, the drilling choke 70*b*, and the valve 66*b* (the valve 66*e* is closed); during and/or after the step 128, the step 136 at which the drilling mud flows from the flow block 64*a* to the flow block 86*a* via the valve 88*a*, and from the flow block 86*a* to the flow block 86*b* via the valve 88*e* (the valves 88*b*, 88*c* and 88*d* are closed); during and/or after the step 136, the step 138 at which the drilling mud is discharged via the flow fitting 106*b* operably coupled to the flow block 86*b* in substantially the same manner as the manner in which the flow fitting 104*a* is operably coupled to the flow block 86*a*.

For yet another example, an illustrative embodiment of the method 124 includes: the step 126 at which the drilling mud is received from the wellbore via the flow fitting 106*a* operably coupled to the flow block 64*b* in substantially the same manner as the manner in which the flow fitting 104*b* is operably coupled to the flow block 64*a*; during and/or after the step 126, the step 130 at which the drilling mud flows from the flow block 64*b* to the flow block 64*a* via the valve 66*e* (the valves 66*c* and 66*d* are closed); during and/or after the step 130, the step 134 at which the drilling mud flows from the flow block 64*a* to the flow block 86*a* via the valve 88*a*, and from the flow block 86*a* to the flow block 86*b* via the valve 88*b*, the spool 100*a*, the flow block 98*a*, the spool 100*b*, the flow block 98*b*, the flow meter 96, and the valve 88*d* (the valves 88*c* and 88*e* are closed); during and/or after the step 134, the step 138 at which the drilling mud is discharged via the flow fitting 106*b* operably coupled to the flow block 86*b* in substantially the same manner as the manner in which the flow fitting 104*a* is operably coupled to the flow block 86*a*.

For yet another example, an illustrative embodiment of the method 124 includes: the step 126 at which the drilling mud is received from the wellbore via the flow fitting 106*a* operably coupled to the flow block 64*b* in substantially the same manner as the manner in which the flow fitting 104*b* is operably coupled to the flow block 64*a*; during and/or after the step 126, the step 130 at which the drilling mud flows from the flow block 64*b* to the flow block 64*a* via the valve 66*e* (the valves 66*c* and 66*d* are closed); during and/or after the step 130, the step 136 at which the drilling mud flows from the flow block 64*a* to the flow block 86*a* via the valve 88*a*, and from the flow block 86*a* to the flow block 86*b* via the valve 88*e* (the valves 88*b*, 88*c*, and 88*d* are closed); during and/or after the step 136, the step 138 at which the drilling mud is discharged via the flow fitting 106*b* operably coupled to the flow block 86*b* in substantially the same manner as the manner in which the flow fitting 104*a* is operably coupled to the flow block 86*a*.

In some embodiments, the configuration of the MPD manifold 20, including the drilling chokes 70*a* and 70*b* and the flow meter 96 used to carry out the method 124, optimizes the efficiency of the drilling system 10, thereby improving the cost and effectiveness of drilling operations. Such improved efficiency benefits operators dealing with challenges such as, for example, continuous duty operations, harsh downhole environments, and multiple extended-reach lateral wells, among others. In some embodiments, the configuration of the MPD manifold 20, including the drilling chokes 70*a* and 70*b* and the flow meter 96 used to carry out the method 124, favorably affects the size and/or weight of the MPD manifold 20, and thus the transportability and overall footprint of the MPD manifold 20 at the wellsite.

In some embodiments, the integrated nature of the drilling chokes 70*a* and 70*b* and the flow meter 96 on the MPD manifold 20 used to carry out the method 124 makes it easier to inspect, service, or repair the MPD manifold 20, thereby decreasing downtime during drilling operations. In some embodiments, the integrated nature of the drilling chokes 70*a* and 70*b* and the flow meter 96 on the MPD manifold 20 used to carry out the method 124 makes it easier to coordinate the inspection, service, repair, or replacement of components of the MPD manifold 20 such as, for example, the drilling chokes 70*a* and 70*b* and/or the flow meter 96, among other components. In this regard, an arrow 140 in FIGS. 3-6 indicates the direction in which the drilling choke 70*a* is readily removable from the choke module 36 upon decoupling of the spools 72*a* and 74*a* from the valves 66*a* and 66*c*, respectively, or decoupling of the flow block 68*a* and the drilling choke 70*a* from the respective spools 72*a* and 74*a*. Moreover, the arrow 140 indicates the direction in which the drilling choke 70*b* is readily removable from the choke module 36 upon decoupling of the spools 72*b* and 74*b* from the valves 66*b* and 66*d*, respectively, or decoupling of the flow block 68*b* and the drilling choke 70*b* from the respective spools 72*b* and 74*b*. Accordingly, one of the drilling chokes 70*a* and 70*b* may be readily inspected, serviced, repaired, or replaced during drilling operations while the other of the drilling chokes 70*a* and 70*b* remains in service.

Figure 28:
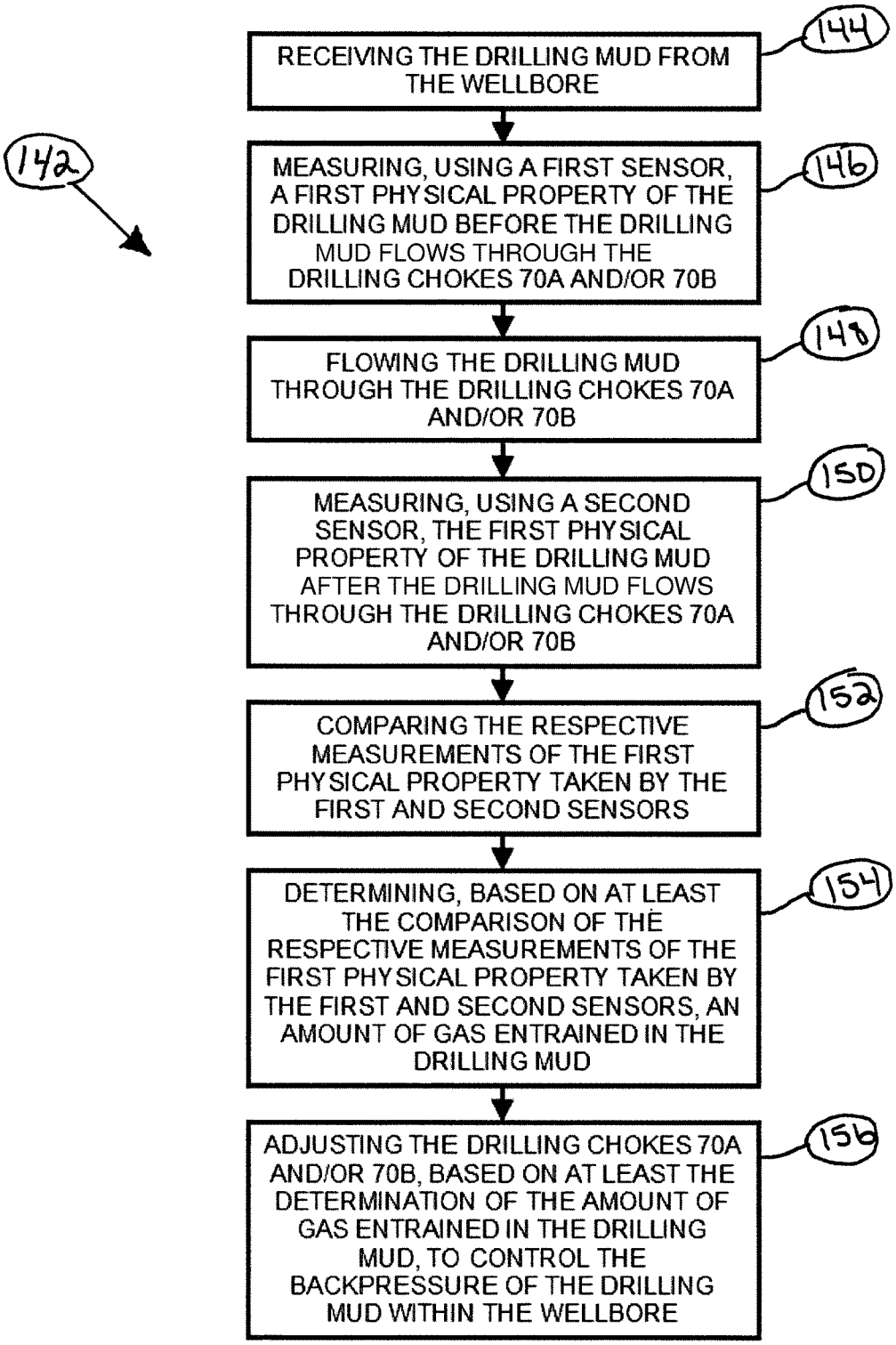
FIG. 28 is a flow chart illustration of a method of controlling backpressure of a drilling mud within a wellbore, according to another illustrative embodiment.

In an illustrative embodiment, as depicted in FIG. 28, with continuing reference to FIGS. 1-26, a method of controlling backpressure of a drilling mud within a wellbore is generally referred to by the reference numeral 142. The method 142 includes receiving the drilling mud from the wellbore at a step 144; measuring, using a first sensor, a first physical property of the drilling mud before the drilling mud flows through the drilling chokes 70*a* and/or 70*b* at a step 146; flowing the drilling mud through the drilling chokes 70*a* and/or 70*b* at a step 148; measuring, using a second sensor, the first physical property of the drilling mud after the drilling mud flows through the drilling chokes 70*a* and/or 70*b* at a step 150; comparing the respective measurements of the first physical property taken by the first and second sensors at a step 152; determining, based on at least the comparison of the respective measurements of the first physical property taken by the first and second sensors, an amount of gas entrained in the drilling mud at a step 154; and adjusting the drilling chokes 70*a* and/or 70*b*, based on the determination of the amount of gas entrained in the drilling mud, to control the backpressure of the drilling mud within the wellbore at a step 156. In some embodiments, when the amount of gas entrained in the drilling mud is above a critical threshold, the drilling chokes 70*a* and/or 70*b* are adjusted to increase the backpressure of the drilling mud within the wellbore. In some embodiments, in addition to, or instead of, determining the amount of gas entrained in the drilling mud, the step 154 includes determining, based on at least the comparison of the respective measurements of the first physical property taken by the first and second sensors, the weight of the drilling mud. As a result, the step 156 includes adjusting the drilling chokes 70*a* and/or 70*b*, based on the determination of the weight of the drilling mud, to control the backpressure of the drilling mud within the wellbore.

In an illustrative embodiment of the steps 146, 148, and 150, the first physical property is density and the first and second sensors are the densometers 46 and 50. In another illustrative embodiment of the steps 146, 148, and 150, the first physical property is temperature and the first and second sensors are temperature sensors 44 and 48. In yet another illustrative embodiment of the steps 146, 148, and 150, the first physical property is pressure and the first and second sensors are pressure sensors operably coupled to the measurement fittings 102*a*, 102*b*, 108, and/or another measurement fitting; in some embodiments, these pressure sensors may be, may include, or may be a part of, the pressure monitoring equipment 103 and/or 107.

In some embodiments of the method 142, the steps 146, 148, and 150 further include measuring, using a third sensor, a second physical property of the drilling mud before the drilling mud flows through the drilling chokes 70*a* and/or

70*b*, measuring, using a fourth sensor, the second physical property of the drilling mud after the drilling mud flows through the drilling chokes 70*a* and/or 70*b*, and comparing the respective measurements of the second physical property taken by the third and fourth sensors. In some embodiments, determining the amount of gas entrained in the drilling mud is further based on the comparison of the respective measurements of the second physical property taken by the third and fourth sensors. In an illustrative embodiment, the first physical property is density and the first and second sensors are the densometers 46 and 50, and the second physical property is temperature and the third and fourth sensors are the temperature sensors 44 and 48. In another illustrative embodiment, the first physical property is density and the first and second sensors are the densometers 46 and 50, and the second physical property is pressure and the third and fourth sensors are pressure sensors operably coupled to the measurement fittings 102*a*, 102*b*, 108, and/or another measurement fitting; in some embodiments, these pressure sensors may be, may include, or may be a part of, the pressure monitoring equipment 103 and/or 107. In yet another illustrative embodiment, the first physical property is temperature and the first and second sensors are the temperature sensors 44 and 48, and the second physical property is pressure and the third and fourth sensors are pressure sensors operably coupled to the measurement fittings 102*a*, 102*b*, 108, and/or another measurement fitting.

In some embodiments of the method 142, the steps 146, 148, and 150 further include measuring, using a fifth sensor, a third physical property of the drilling mud before the drilling mud flows through the drilling chokes 70*a* and/or 70*b*, measuring, using a sixth sensor, the third physical property of the drilling mud after the drilling mud flows through the drilling chokes 70*a* and/or 70*b*, and comparing the respective measurements of the third physical property taken by the fifth and sixth sensors. In some embodiments, determining the amount of gas entrained in the drilling mud is further based on the comparison of the respective measurements of the third physical property taken by the fifth and sixth sensors. In an illustrative embodiment, the first physical property is density and the first and second sensors are densometers 46 and 50, wherein the second physical property is temperature and the third and fourth sensors are the temperature sensors 44 and 48, and wherein the third physical property is pressure and the fifth and sixth sensors are pressure sensors operably coupled to the measurement fittings 102*a*, 102*b*, 108, and/or another measurement fitting; in some embodiments, these pressure sensors may be, may include, or may be a part of, the pressure monitoring equipment 103 and/or 107.

Figure 4:
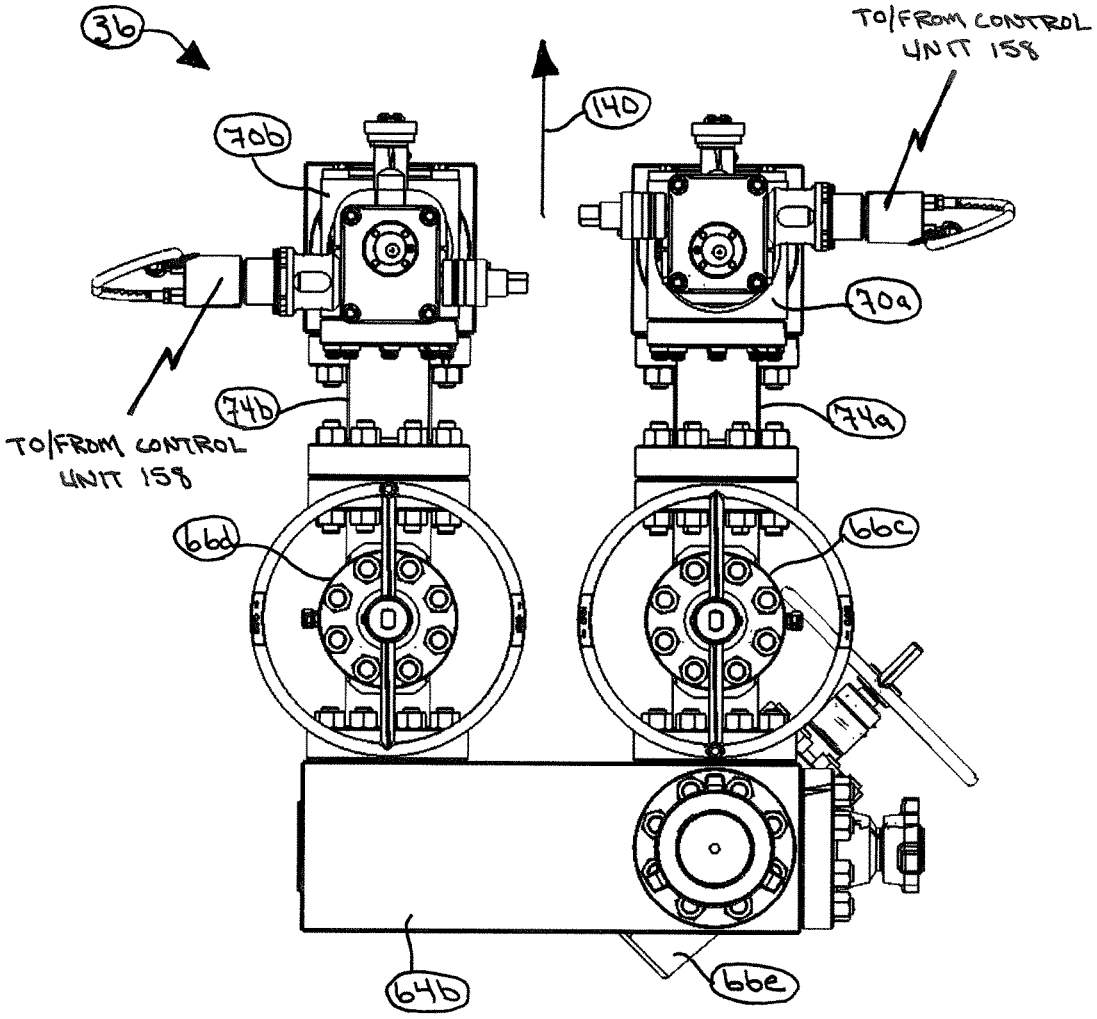
FIG. 4 is a right side elevational view of the choke module of FIG. 3, according to an illustrative embodiment.
Figure 5:
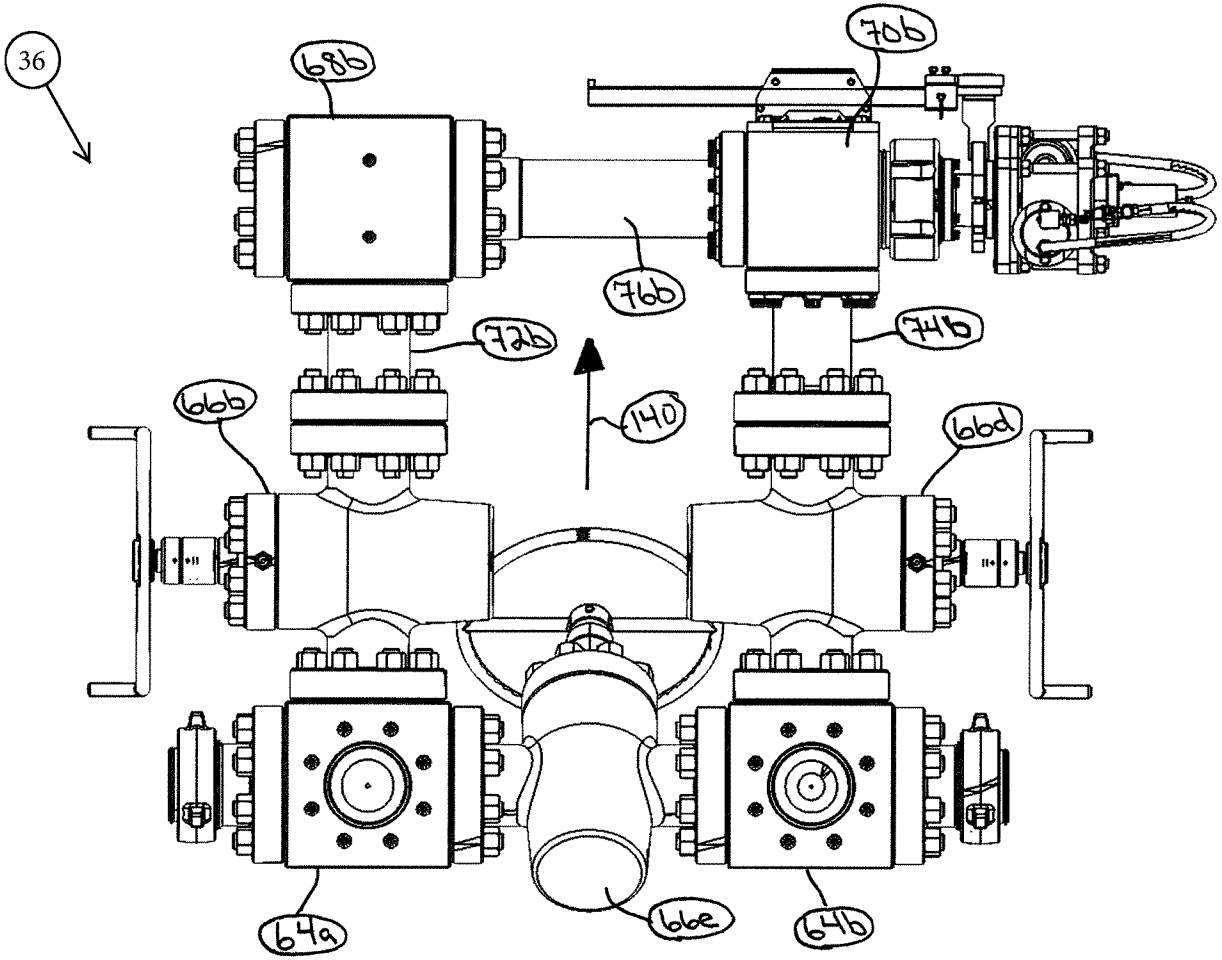
FIG. 5 is a front elevational view of the choke module of FIGS. 3 and 4, according to an illustrative embodiment.
Figure 29:
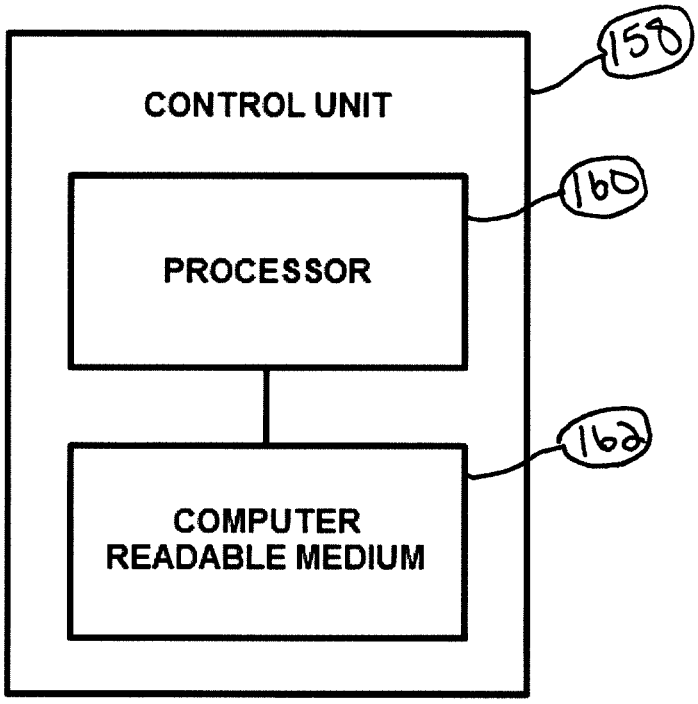
FIG. 29 is a diagrammatic view of a control unit adapted to be connected to one or more components (or sub-components) of the drilling system of FIG. 1, according to an illustrative embodiment.

In an illustrative embodiment, as depicted in FIG. 29 with continuing reference to FIGS. 1-28, a control unit is generally referred to by the reference numeral 158 and includes a processor 160 and a non-transitory computer readable medium 162 operably coupled thereto; a plurality of instructions are stored on the non-transitory computer readable medium 162, the instructions being accessible to, and executable by, the processor 160. In some embodiments, as depicted in FIGS. 4 and 6, the control unit 158 is in communication with the drilling chokes 70*a* and 70*b*. In some embodiments, as depicted in FIGS. 2 and 26, the control unit 158 is also in communication with the flow meter module 38 and, therefore, the control unit 158 may communicate control signals to the drilling chokes 70*a* and 70*b* based on measurement data received from the flow meter module 38. In some embodiments, as depicted in FIGS. 2 and 26, the control unit 158 is also in communication with the temperature sensors 44 and 48 and, therefore, the control unit 158 may communicate control signals to the drilling chokes 70*a* and 70*b* based on measurement data received from the temperature sensors 44 and 48. In some embodiments, as depicted in FIGS. 2 and 26, the control unit 158 is also in communication with the densometers 46 and 50 and, therefore, the control unit 158 may communicate control signals to the drilling chokes 70*a* and 70*b* based on measurement data received from the densometers 46 and 50. In some embodiments, the control unit 158 is also in communication with pressure sensors operably coupled to the measurement fittings 102*a*, 102*b*, 108, and/or another measurement fitting, and, therefore, the control unit 158 may communicate control signals to the drilling chokes 70*a* and 70*b* based on measurement data received from the pressure sensors; in some embodiments, these pressure sensors may be, may include, or may be part of, the pressure monitoring equipment 103 and/or 107. Finally, in some embodiments, the control unit 158 is also in communication with one or more other sensors associated with the drilling system 10 such as, for example, one or more sensors associated with the drilling tool 18, the wellhead 12, the BOP 14, the RCD 16, the MGS 22, the flare 24, the shaker 26, and/or the mud pump 28; therefore, the control unit 158 may communicate control signals to the drilling chokes 70*a* and 70*b* based on measurement data received from the one or more sensors.

In some embodiments, a plurality of instructions, or computer program(s), are stored on a non-transitory computer readable medium, the instructions or computer program(s) being accessible to, and executable by, one or more processors. In some embodiments, the one or more processors execute the plurality of instructions (or computer program(s)) to operate in whole or in part the above-described illustrative embodiments. In some embodiments, the one or more processors are part of the control unit 158, one or more other computing devices, or any combination thereof. In some embodiments, the non-transitory computer readable medium is part of the control unit 158, one or more other computing devices, or any combination thereof.

Figure 30:
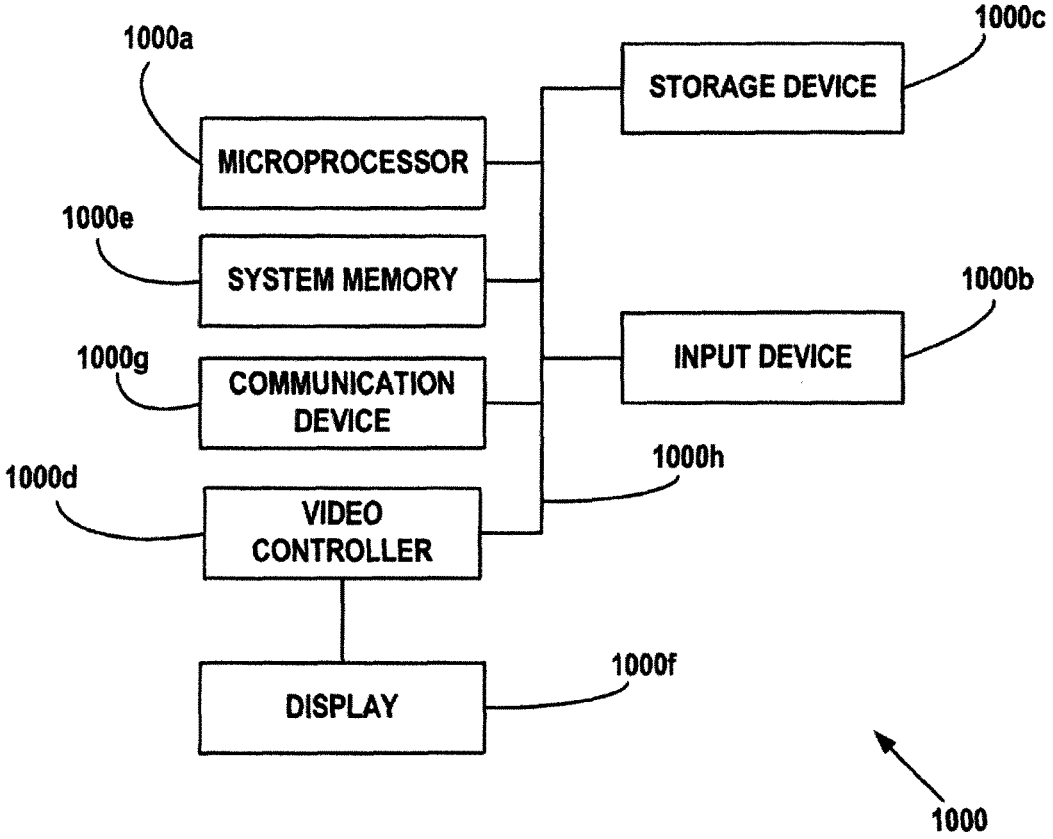
FIG. 30 is a diagrammatic illustration of a computing device for implementing one or more illustrative embodiments of the present disclosure, according to an illustrative embodiment.

In an illustrative embodiment, as depicted in FIG. 30 with continuing reference to FIGS. 1-29, an illustrative computing device 1000 for implementing one or more embodiments of one or more of the above-described networks, elements, methods and/or steps, and/or any combination thereof, is depicted. The computing device 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In some embodiments, the storage device 1000*c* may include a floppy drive, hard drive, CD-ROM, optical drive, any other form of storage device and/or any combination thereof. In some embodiments, the storage device 1000*c* may include, and/or be capable of receiving, a floppy disk, CD-ROM, DVD-ROM, or any other form of computer-readable medium that may contain executable instructions. In some embodiments, the communication device 1000*g* may include a modem, network card, or any other device to enable the computing device to communicate with other computing devices. In some embodiments, any computing device represents a plurality of interconnected (whether by intranet or Internet) computer systems, including without limitation, personal computers, mainframes, PDAs, smartphones and cell phones.

In some embodiments, one or more of the components of the above-described illustrative embodiments include at least the computing device 1000 and/or components thereof, and/or one or more computing devices that are substantially similar to the computing device 1000 and/or components thereof. In some embodiments, one or more of the above-described components of the computing device 1000 include respective pluralities of same components.

In some embodiments, a computer system typically includes at least hardware capable of executing machine readable instructions, as well as the software for executing acts (typically machine-readable instructions) that produce a desired result. In some embodiments, a computer system may include hybrids of hardware and software, as well as computer sub-systems.

In some embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In some embodiments, hardware may include any physical device that is capable of storing machine-readable instructions, such as memory or other data storage devices. In some embodiments, other forms of hardware include hardware sub-systems, including transfer devices such as modems, modem cards, ports, and port cards, for example.

In some embodiments, software includes any machine code stored in any memory medium, such as RAM or ROM, and machine code stored on other devices (such as floppy disks, flash memory, or a CD ROM, for example). In some embodiments, software may include source or object code. In some embodiments, software encompasses any set of instructions capable of being executed on a computing device such as, for example, on a client machine or server.

In some embodiments, combinations of software and hardware could also be used for providing enhanced functionality and performance for certain embodiments of the present disclosure. In an illustrative embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In some embodiments, computer readable mediums include, for example, passive data storage, such as a random access memory (RAM) as well as semi-permanent data storage such as a compact disk read only memory (CD-ROM). One or more illustrative embodiments of the present disclosure may be embodied in the RAM of a computer to transform a standard computer into a new specific computing machine. In some embodiments, data structures are defined organizations of data that may enable an embodiment of the present disclosure. In an illustrative embodiment, a data structure may provide an organization of data, or an organization of executable code.

In some embodiments, any networks and/or one or more portions thereof, may be designed to work on any specific architecture. In an illustrative embodiment, one or more portions of any networks may be executed on a single computer, local area networks, client-server networks, wide area networks, internets, hand-held and other portable and wireless devices and networks.

In some embodiments, a database may be any standard or proprietary database software. In some embodiments, the database may have fields, records, data, and other database elements that may be associated through database specific software. In some embodiments, data may be mapped. In some embodiments, mapping is the process of associating one data entry with another data entry. In an illustrative embodiment, the data contained in the location of a character file can be mapped to a field in a second table. In some embodiments, the physical location of the database is not limiting, and the database may be distributed. In an illustrative embodiment, the database may exist remotely from the server, and run on a separate platform. In an illustrative embodiment, the database may be accessible across the Internet. In some embodiments, more than one database may be implemented.

In some embodiments, a plurality of instructions stored on a non-transitory computer readable medium may be executed by one or more processors to cause the one or more processors to carry out or implement in whole or in part the above-described operation of each of the above-described illustrative embodiments of the drilling system 10, the MPD manifold 20, the method 124, the method 142, and/or any combination thereof. In some embodiments, such a processor may include one or more of the microprocessor 1000*a*, the processor 160, and/or any combination thereof, and such a non-transitory computer readable medium may include the computer readable medium 162 and/or may be distributed among one or more components of the drilling system 10 and/or the MPD manifold. In some embodiments, such a processor may execute the plurality of instructions in connection with a virtual computer system. In some embodiments, such a plurality of instructions may communicate directly with the one or more processors, and/or may interact with one or more operating systems, middleware, firmware, other applications, and/or any combination thereof, to cause the one or more processors to execute the instructions.

In a first aspect, the present disclosure introduces a managed pressure drilling ("MPD") manifold adapted to receive drilling mud from a wellbore, the MPD manifold including: a first module including one or more drilling chokes; a second module including a flow meter; and a third module including first and second flow blocks operably coupled in parallel between the first and second modules; wherein the one or more drilling chokes are adapted to control backpressure of the drilling mud within the wellbore; and wherein the flow meter is adapted to measure a flow rate of the drilling mud received from the wellbore. In an illustrative embodiment, the third module further includes: a first valve operably coupled between, and in fluid communication with, the first flow block and the first module; a second valve operably coupled between, and in fluid communication with, the first flow block and the second module; a third valve operably coupled between, and in fluid communication with, the second flow block and the first module; and a fourth valve operably coupled between, and in fluid communication with, the second flow block and the second module. In an illustrative embodiment, the third module further includes a fifth valve operably coupled between, and in fluid communication with, the first and second flow blocks. In an illustrative embodiment, the third module is actuable between: a first configuration in which fluid flow is permitted from the first flow block to the second flow block via the second valve, the flow meter, and the fourth valve, and fluid flow is prevented, or at least reduced, from the first flow block to the second flow block via the fifth valve; and a second configuration in which fluid flow is prevented, or at least reduced, from the first flow block to the second flow block via the second valve, the flow meter, and the fourth valve, and fluid flow is permitted from the first flow block to the second flow block via the fifth valve. In an illustrative embodiment, in the first configuration, the first, second, third, fourth, and fifth valves are actuated so that either: the second, third, and fourth valves are open and the first and fifth valves are closed, or the first, second, and fourth valves are open and the third and fifth valves are closed; and wherein, in the second configuration, the first, second, third, fourth, and fifth valves are actuated so that either: the third and fifth valves are open and the first, second, and fourth valves are closed, or the first and fifth valves are open and the second, third, and fourth valves are closed. In an illustrative embodiment, the first and second fluid passageways of the first flow block are generally coaxial, and the first and second fluid passageways of the second flow block are generally coaxial, so that the second module, including the flow meter, extends in a generally horizontal orientation. In an illustrative embodiment, the first and second fluid passageways of the first flow block define generally perpendicular axes, and the first and second fluid passageways of the second flow block define generally perpendicular axes, so that the second module, including the flow meter, extends in a generally vertical orientation. In an illustrative embodiment, the first and second flow blocks each include first, second, third, fourth, fifth, and sixth sides, the third, fourth, fifth, and sixth sides extending between the first and second sides, the first, third, and fourth fluid passageways extending through the first, third, and fourth sides, respectively, and the second fluid passageway extending through either the second side or the fifth side. In an illustrative embodiment, the second module further includes third and fourth flow blocks, and first and second spools, the first spool being operably coupled to, and in fluid communication with, the third flow block, the second spool being operably coupled between, and in fluid communication with, the third and fourth flow blocks, and the flow meter being operably coupled to, and in fluid communication with, the fourth flow block.

In a second aspect, the present disclosure also introduces a managed pressure drilling ("MPD") manifold adapted to receive drilling mud from a wellbore, the MPD manifold including: a first module including one or more drilling chokes; a second module including a flow meter; and a third module operably coupled between, and in fluid communication with, the first and second modules, the third module being configured to support the second module in either: a generally horizontal orientation; or a generally vertical orientation; wherein the one or more drilling chokes are adapted to control backpressure of the drilling mud within the wellbore; and wherein the flow meter is adapted to measure a flow rate of the drilling mud received from the wellbore. In an illustrative embodiment, the first and second modules are together mounted to either a skid or a trailer so that, when so mounted, the first and second modules are together towable between operational sites. In an illustrative embodiment, the third module includes first and second flow blocks operably coupled in parallel between the first and second modules, the first and second flow blocks each defining an internal region and first, second, third, fourth, and fifth fluid passageways extending into the internal region. In an illustrative embodiment, when the third module supports the second module in the generally horizontal orientation: the first module is operably coupled to, and in fluid communication with, the internal region of the first flow block via the first fluid passageway thereof, and the second module is operably coupled to, and in fluid communication with, the internal region of the first flow block via the second fluid passageway thereof; and the first module is operably coupled to, and in fluid communication with, the internal region of the second flow block via the first fluid passageway thereof, and the second module is operably coupled to, and in fluid communication with, the internal region of the second flow block via the second fluid passageway thereof. In an illustrative embodiment, when the third module supports the second module in the generally vertical orientation: the first module is operably coupled to, and in fluid communication with, the internal region of the first flow block via the first fluid passageway thereof, and the second module is operably coupled to, and in fluid communication with, the internal region of the first flow block via the fifth fluid passageway thereof; and the first module is operably coupled to, and in fluid communication with, the internal region of the second flow block via the first fluid passageway thereof, and the second module is operably coupled to, and in fluid communication with, the internal region of the second flow block via the fifth fluid passageway thereof. In an illustrative embodiment, the first and second flow blocks each include first, second, third, fourth, fifth, and sixth sides, the third, fourth, fifth, and sixth sides extending between the first and second sides, and the first, second, third, fourth, and fifth fluid passageways extending through the first, second, third, fourth, and fifth sides. In an illustrative embodiment, the third module further includes first, second, third, fourth, and fifth valves, the first and second valves being operably coupled to, and in fluid communication with, the first flow block and the respective first and second modules, the third and fourth valves being operably coupled to, and in fluid communication with, the second flow block and the respective first and second modules, and the fifth valve being operably coupled between, and in fluid communication with, the first and second flow blocks. In an illustrative embodiment, the second module further includes first and second flow blocks, and first and second spools, the first spool being operably coupled to, and in fluid communication with, the first flow block, the second spool being operably coupled between, and in fluid communication with, the first and second flow blocks, and the flow meter being operably coupled to, and in fluid communication with, the second flow block.

In a third aspect, the present disclosure also introduces a managed pressure drilling ("MPD") manifold adapted to receive drilling mud from a wellbore, the MPD manifold including: a first flow block into which the drilling mud is adapted to flow from the wellbore; a second flow block into which the drilling mud is adapted to flow from the first flow block; a first valve operably coupled to the first and second flow blocks; and a choke module including a first drilling choke, the choke module being actuable between: a backpressure control configuration in which: the first drilling choke is in fluid communication with the first flow block to control backpressure of the drilling mud within the wellbore; the second flow block is in fluid communication with the first flow block via the first drilling choke; and the second flow block is not in fluid communication with the first flow block via the first valve; and a choke bypass configuration in which: the first drilling choke is not in fluid communication with the first flow block; the second flow block is not in fluid communication with the first flow block via the first drilling choke; and the second flow block is in fluid communication with the first flow block via the first valve. In an illustrative embodiment, the MPD manifold further includes a valve module operably coupled to the choke module, the valve module including a second valve; and a flow meter module operably coupled to the valve module, the flow meter module including a flow meter; wherein the valve module is actuable between: a flow metering configuration in which: the second flow block is in fluid communication with the first flow block via the flow meter; and the second flow block is not in fluid communication with the first flow block via the second valve; and a meter bypass configuration in which: the second flow block is not in fluid communication with the first flow block via the flow meter; and the second flow block is in fluid communication with the first flow block via the second valve. In an illustrative embodiment, the choke module further includes a second drilling choke; and wherein the second flow block is adapted to be in fluid communication with the first flow block via one or both of the first drilling choke and the second drilling choke. In an illustrative embodiment, the valve module includes either the first flow block or the second flow block. In an illustrative embodiment, the choke module includes the first flow block and the valve module includes the second flow block. In an illustrative embodiment, the choke module includes the second flow block and the valve module includes the first flow block. In an illustrative embodiment, the flow meter is a coriolis flow meter. In an illustrative embodiment, the choke module includes the first valve. In an illustrative embodiment, the choke module includes either the first flow block or the second flow block. In an illustrative embodiment, the choke module includes the first valve, the first flow block, and the second flow block.

It is understood that variations may be made in the foregoing without departing from the scope of the present disclosure.

In several illustrative embodiments, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments.

In several illustrative embodiments, while different steps, processes, and procedures are described as appearing as distinct acts, one or more of the steps, one or more of the processes, and/or one or more of the procedures may also be performed in different orders, simultaneously and/or sequentially. In several illustrative embodiments, the steps, processes and/or procedures may be merged into one or more steps, processes and/or procedures.

In several illustrative embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

Although several illustrative embodiments have been described in detail above, the embodiments described are illustrative only and are not limiting, and those skilled in the art will readily appreciate that many other modifications, changes and/or substitutions are possible in the illustrative embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A managed pressure drilling ("MPD") manifold adapted to receive drilling mud from a wellbore, the MPD manifold comprising:

a first module comprising one or more drilling chokes;

a second module comprising a flow meter; and a third module comprising first and second flow blocks operably coupled in parallel between the first and second modules;

wherein the one or more drilling chokes are adapted to control backpressure of the drilling mud within the wellbore;

wherein the flow meter is adapted to measure a flow rate of the drilling mud received from the wellbore;

wherein the third module further comprises:

a first valve operably coupled between, and in fluid communication with, the first flow block and the first module;

a second valve operably coupled between, and in fluid communication with, the first flow block and the second module;

a third valve operably coupled between, and in fluid communication with, the second flow block and the first module; and a fourth valve operably coupled between, and in fluid communication with, the second flow block and the second module;

wherein the third module further comprises a fifth valve operably coupled between, and in fluid communication with, the first and second flow blocks;

wherein the first and second flow blocks each define an internal region, and first, second, third, and fourth fluid passageways, each extending into the internal region;

wherein the first, second, and fifth valves are in fluid communication with the internal region of the first flow block via the respective first, second, and fourth fluid passageways thereof; and wherein the third, fourth, and fifth valves are in fluid communication with the internal region of the second flow block via the respective first, second, and third fluid passageways thereof.

2. The MPD manifold of claim 1, wherein the third module further comprises one or both of:

a first flow fitting operably coupled to, and in fluid communication with, the internal region of the first flow block via the third fluid passageway thereof, the first flow fitting being adapted to receive the drilling mud from the wellbore;

and a second flow fitting operably coupled to, and in fluid communication with, the internal region of the second flow block via the fourth fluid passageway thereof, the second flow fitting being adapted to discharge the drilling mud from the third module.

3. The MPD manifold of claim 1, wherein the third module is actuable between:

a first configuration in which fluid flow is permitted from the first flow block to the second flow block via the second valve, the flow meter, and the fourth valve, and fluid flow is prevented, or at least reduced, from the first flow block to the second flow block via the fifth valve; and a second configuration in which fluid flow is prevented, or at least reduced, from the first flow block to the second flow block via the second valve, the flow meter, and the fourth valve, and fluid flow is permitted from the first flow block to the second flow block via the fifth valve.

4. The MPD manifold of claim 3, wherein, in the first configuration, the first, second, third, fourth, and fifth valves are actuated so that either:

the second, third, and fourth valves are open and the first and fifth valves are closed, or the first, second, and fourth valves are open and the third and fifth valves are closed;

and wherein, in the second configuration, the first, second, third, fourth, and fifth valves are actuated so that either:

the third and fifth valves are open and the first, second, and fourth valves are closed, or the first and fifth valves are open and the second, third, and fourth valves are closed.

5. The MPD manifold of claim 1, wherein the MPD manifold has:

a first configuration in which fluid flow is permitted between the first and second modules via the first and second fluid passageways of the first flow block; and a second configuration in which fluid flow is permitted between the first and second modules via the first and second fluid passageways of the second flow block.

6. The MPD manifold of claim 5, wherein the first and second fluid passageways of the first flow block are generally coaxial, and the first and second fluid passageways of the second flow block are generally coaxial, so that the second module, including the flow meter, extends in a generally horizontal orientation.

7. The MPD manifold of claim 5, wherein the first and second flow blocks each comprise first, second, third, fourth, fifth, and sixth sides, the third, fourth, fifth, and sixth sides extending between the first and second sides, the first, third, and fourth fluid passageways extending through the first, third, and fourth sides, respectively, and the second fluid passageway extending through either the second side or the fifth side.

8. The MPD manifold of claim 5, wherein the second module further comprises third and fourth flow blocks, and first and second spools, the first spool being operably coupled to, and in fluid communication with, the third flow block, the second spool being operably coupled between, and in fluid communication with, the third and fourth flow blocks, and the flow meter being operably coupled to, and in fluid communication with, the fourth flow block.

9. A managed pressure drilling ("MPD") manifold adapted to receive drilling mud from a wellbore, the MPD manifold comprising:

a first module comprising one or more drilling chokes;

a second module comprising a flow meter; and a third module comprising first and second flow blocks operably coupled in parallel between the first and second modules;

wherein the one or more drilling chokes are adapted to control backpressure of the drilling mud within the wellbore;

wherein the flow meter is adapted to measure a flow rate of the drilling mud received from the wellbore; and wherein the first and second flow blocks each define an internal region, and first, second, third, and fourth fluid passageways, each extending into the internal region; and wherein the MPD manifold has:

a first configuration in which fluid flow is permitted between the first and second modules via the first and second fluid passageways of the first flow block; and a second configuration in which fluid flow is permitted between the first and second modules via the first and second fluid passageways of the second flow block.

10. The MPD manifold of claim 9, wherein the first and second fluid passageways of the first flow block are generally coaxial, and the first and second fluid passageways of the second flow block are generally coaxial, so that the second module, including the flow meter, extends in a generally horizontal orientation.

11. The MPD manifold of claim 9, wherein the first and second fluid passageways of the first flow block define generally perpendicular axes, and the first and second fluid passageways of the second flow block define generally perpendicular axes, so that the second module, including the flow meter, extends in a generally vertical orientation.

12. The MPD manifold of claim 9, wherein the first and second flow blocks each comprise first, second, third, fourth, fifth, and sixth sides, the third, fourth, fifth, and sixth sides extending between the first and second sides, the first, third, and fourth fluid passageways extending through the first, third, and fourth sides, respectively, and the second fluid passageway extending through either the second side or the fifth side.

13. The MPD manifold of claim 9, wherein the second module further comprises third and fourth flow blocks, and first and second spools, the first spool being operably coupled to, and in fluid communication with, the third flow block, the second spool being operably coupled between, and in fluid communication with, the third and fourth flow blocks, and the flow meter being operably coupled to, and in fluid communication with, the fourth flow block.

14. The MPD manifold of claim 9, wherein the third module further comprises:

a first valve operably coupled between, and in fluid communication with, the first flow block and the first module;

a second valve operably coupled between, and in fluid communication with, the first flow block and the second module;

a third valve operably coupled between, and in fluid communication with, the second flow block and the first module; and a fourth valve operably coupled between, and in fluid communication with, the second flow block and the second module.

15. The MPD manifold of claim 14, wherein the third module further comprises a fifth valve operably coupled between, and in fluid communication with, the first and second flow blocks.

16. The MPD manifold of claim 15, wherein the third module is actuable between:

a first configuration in which fluid flow is permitted from the first flow block to the second flow block via the second valve, the flow meter, and the fourth valve, and fluid flow is prevented, or at least reduced, from the first flow block to the second flow block via the fifth valve; and a second configuration in which fluid flow is prevented, or at least reduced, from the first flow block to the second flow block via the second valve, the flow meter, and the fourth valve, and fluid flow is permitted from the first flow block to the second flow block via the fifth valve.

17. The MPD manifold of claim 16, wherein, in the first configuration, the first, second, third, fourth, and fifth valves are actuated so that either:

the second, third, and fourth valves are open and the first and fifth valves are closed, or the first, second, and fourth valves are open and the third and fifth valves are closed;

and wherein, in the second configuration, the first, second, third, fourth, and fifth valves are actuated so that either:

the third and fifth valves are open and the first, second, and fourth valves are closed, or the first and fifth valves are open and the second, third, and fourth valves are closed.

18. A managed pressure drilling ("MPD") manifold adapted to receive drilling mud from a wellbore, the MPD manifold comprising:

a first module comprising one or more drilling chokes;

a second module comprising a flow meter; and a third module operably coupled between, and in fluid communication with, the first and second modules, the third module being configured to support the second module in either:

a generally horizontal orientation; or a generally vertical orientation;

wherein the one or more drilling chokes are adapted to control backpressure of the drilling mud within the wellbore;

wherein the flow meter is adapted to measure a flow rate of the drilling mud received from the wellbore; and wherein the third module comprises first and second flow blocks operably coupled in parallel between the first and second modules, the first and second flow blocks each defining an internal region and first, second, third, fourth, and fifth fluid passageways extending into the internal region.

19. The MPD manifold of claim 18, wherein, when the third module supports the second module in the generally horizontal orientation:

the first module is operably coupled to, and in fluid communication with, the internal region of the first flow block via the first fluid passageway thereof, and the second module is operably coupled to, and in fluid communication with, the internal region of the first flow block via the second fluid passageway thereof; and the first module is operably coupled to, and in fluid communication with, the internal region of the second flow block via the first fluid passageway thereof, and the second module is operably coupled to, and in fluid communication with, the internal region of the second flow block via the second fluid passageway thereof.

20. The MPD manifold of claim 19, wherein, when the third module supports the second module in the generally vertical orientation:

the first module is operably coupled to, and in fluid communication with, the internal region of the first flow block via the first fluid passageway thereof, and the second module is operably coupled to, and in fluid communication with, the internal region of the first flow block via the fifth fluid passageway thereof; and the first module is operably coupled to, and in fluid communication with, the internal region of the second flow block via the first fluid passageway thereof, and the second module is operably coupled to, and in fluid communication with, the internal region of the second flow block via the fifth fluid passageway thereof.

21. The MPD manifold of claim 18, wherein the first and second flow blocks each comprise first, second, third, fourth, fifth, and sixth sides, the third, fourth, fifth, and sixth sides extending between the first and second sides, and the first, second, third, fourth, and fifth fluid passageways extending through the first, second, third, fourth, and fifth sides.

22. The MPD manifold of claim 18, wherein the third module further comprises first, second, third, fourth, and fifth valves, the first and second valves being operably coupled to, and in fluid communication with, the first flow block and the respective first and second modules, the third and fourth valves being operably coupled to, and in fluid communication with, the second flow block and the respective first and second modules, and the fifth valve being operably coupled between, and in fluid communication with, the first and second flow blocks.

23. The MPD manifold of claim 18, wherein the first and second modules are together mounted to either a skid or a trailer so that, when so mounted, the first and second modules are together towable between operational sites.

24. A managed pressure drilling ("MPD") manifold adapted to receive drilling mud from a wellbore, the MPD manifold comprising:

a first module comprising one or more drilling chokes;

a second module comprising a flow meter; and a third module operably coupled between, and in fluid communication with, the first and second modules, the third module being configured to support the second module in either:

a generally horizontal orientation; or a generally vertical orientation;

wherein the one or more drilling chokes are adapted to control backpressure of the drilling mud within the wellbore;

wherein the flow meter is adapted to measure a flow rate of the drilling mud received from the wellbore; and wherein the second module further comprises first and second flow blocks, and first and second spools, the first spool being operably coupled to, and in fluid communication with, the first flow block, the second spool being operably coupled between, and in fluid communication with, the first and second flow blocks, and the flow meter being operably coupled to, and in fluid communication with, the second flow block.

25. The MPD manifold of claim 24, wherein the first and second modules are together mounted to either a skid or a trailer so that, when so mounted, the first and second modules are together towable between operational sites.

26. The MPD manifold of claim 24, wherein the third module comprises first and second flow blocks operably coupled in parallel between the first and second modules, the first and second flow blocks each defining an internal region and first, second, third, fourth, and fifth fluid passageways extending into the internal region.

27. The MPD manifold of claim 26, wherein, when the third module supports the second module in the generally horizontal orientation:

the first module is operably coupled to, and in fluid communication with, the internal region of the first flow block via the first fluid passageway thereof, and the second module is operably coupled to, and in fluid communication with, the internal region of the first flow block via the second fluid passageway thereof; and the first module is operably coupled to, and in fluid communication with, the internal region of the second flow block via the first fluid passageway thereof, and the second module is operably coupled to, and in fluid communication with, the internal region of the second flow block via the second fluid passageway thereof.

28. The MPD manifold of claim 26, wherein the first and second flow blocks each comprise first, second, third, fourth, fifth, and sixth sides, the third, fourth, fifth, and sixth sides extending between the first and second sides, and the first, second, third, fourth, and fifth fluid passageways extending through the first, second, third, fourth, and fifth sides.

29. The MPD manifold of claim 26, wherein the third module further comprises first, second, third, fourth, and fifth valves, the first and second valves being operably coupled to, and in fluid communication with, the first flow block and the respective first and second modules, the third and fourth valves being operably coupled to, and in fluid communication with, the second flow block and the respective first and second modules, and the fifth valve being operably coupled between, and in fluid communication with, the first and second flow blocks.

30. A managed pressure drilling ("MPD") manifold adapted to receive drilling mud from a wellbore, the MPD manifold comprising:

a first flow block into which the drilling mud is adapted to flow from the wellbore;

a second flow block into which the drilling mud is adapted to flow from the first flow block;

a first valve operably coupled to the first and second flow blocks; and a choke module comprising a first drilling choke, the choke module being actuable between:

a backpressure control configuration in which:

the first drilling choke is in fluid communication with the first flow block to control backpressure of the drilling mud within the wellbore;

the second flow block is in fluid communication with the first flow block via the first drilling choke; and the second flow block is not in fluid communication with the first flow block via the first valve;

and a choke bypass configuration in which:

the first drilling choke is not in fluid communication with the first flow block;

the second flow block is not in fluid communication with the first flow block via the first drilling choke; and the second flow block is in fluid communication with the first flow block via the first valve wherein the MPD manifold further comprises:

a valve module operably coupled to the choke module, the valve module comprising a second valve; and a flow meter module operably coupled to the valve module, the flow meter module comprising a flow meter;

wherein the valve module is actuable between:

a flow metering configuration in which:

the second flow block is in fluid communication with the first flow block via the flow meter; and the second flow block is not in fluid communication with the first flow block via the second valve;

and a meter bypass configuration in which:

the second flow block is not in fluid communication with the first flow block via the flow meter; and the second flow block is in fluid communication with the first flow block via the second valve.

31. The MPD manifold of claim 30, wherein the choke module further comprises a second drilling choke; and wherein the second flow block is adapted to be in fluid communication with the first flow block via one or both of the first drilling choke and the second drilling choke.

32. The MPD manifold of claim 30, wherein the valve module comprises either the first flow block or the second flow block.

33. The MPD manifold of claim 30, wherein the choke module comprises the first flow block and the valve module comprises the second flow block.

34. The MPD manifold of claim 30, wherein the choke module comprises the second flow block and the valve module comprises the first flow block.

35. The MPD manifold of claim 30, wherein the flow meter is a coriolis flow meter.

36. The MPD manifold of claim 30, wherein the choke module comprises the first valve.

37. The MPD manifold of claim 30, wherein the choke module comprises either the first flow block or the second flow block.

38. The MPD manifold of claim 30, wherein the choke module comprises the first valve, the first flow block, and the second flow block.

* * * * *